US011308852B2

(12) United States Patent
Xiong et al.

(10) Patent No.: US 11,308,852 B2
(45) Date of Patent: Apr. 19, 2022

(54) DRIVING METHOD AND DRIVING DEVICE OF A DISPLAY PANEL, AND DISPLAY DEVICE

(71) Applicant: SHANGHAI TIANMA AM-OLED CO., LTD., Shanghai (CN)

(72) Inventors: Zhiyong Xiong, Shanghai (CN); Zhengxia Lv, Shanghai (CN); Min Yang, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 17/228,669

(22) Filed: Apr. 12, 2021

(65) Prior Publication Data

US 2021/0233457 A1 Jul. 29, 2021

(30) Foreign Application Priority Data

Jan. 4, 2021 (CN) ..... 202110003233.7

(51) Int. Cl.
*G09G 3/20* (2006.01)
*G09G 3/3233* (2016.01)
*G09G 3/3266* (2016.01)

(52) U.S. Cl.
CPC ..... *G09G 3/2074* (2013.01); *G09G 3/2003* (2013.01); *G09G 3/3233* (2013.01); (Continued)

(58) Field of Classification Search
CPC ..... G09G 3/3233; G09G 3/006; G09G 2320/0233; G09G 2320/043; G09G 2300/0842; G09G 2300/0819; G09G 2310/0251; G09G 2310/0262; G09G 2360/147; G09G 2370/049; G09G 5/003
See application file for complete search history.

(56) References Cited

U.S. PATENT DOCUMENTS

2007/0200812 A1* 8/2007 Maede ..... G09G 3/3275 345/92
2014/0028649 A1* 1/2014 Kim ..... G09G 3/3233 345/212

(Continued)

FOREIGN PATENT DOCUMENTS

CN 102113043 A 6/2011
CN 106782329 A 5/2017
CN 111199711 A 5/2020

*Primary Examiner* — Dong Hui Liang
(74) *Attorney, Agent, or Firm* — Kilpatrick Townsend & Stockton, LLP

(57) ABSTRACT

Provided are a driving method and driving device of a display panel, and a display device. A sub-display region in which gray scale values of first sub-pixels are 0 and gray scale values of second sub-pixels are less than a first preset gray scale value is determined as a first sub-display region, and a sub-display region in which not all of the gray scale values of the first sub-pixels are 0 and not all of the gray scale values of the second sub-pixels are less than the first preset gray scale value is determined as a second sub-display region. In a reset stage, a first reset signal is provided to an anode of an organic light emitting element of a sub-pixel of the first sub-display region and a second reset signal is provided to an anode of an organic light emitting element of a sub-pixel of the second sub-display region.

18 Claims, 15 Drawing Sheets

(52) U.S. Cl.
CPC ... *G09G 3/3266* (2013.01); *G09G 2300/0452* (2013.01); *G09G 2300/0809* (2013.01); *G09G 2310/0202* (2013.01); *G09G 2320/0233* (2013.01); *G09G 2320/0242* (2013.01)

(56) References Cited

U.S. PATENT DOCUMENTS

| | | | | |
|---|---|---|---|---|
| 2014/0176626 | A1* | 6/2014 | Sasaki | G09G 3/2051 345/697 |
| 2018/0374426 | A1* | 12/2018 | Chen | G09G 3/3291 |
| 2020/0143760 | A1* | 5/2020 | Kang | G09G 3/3607 |

* cited by examiner

--Prior Art--

DRIVING METHOD AND DRIVING DEVICE OF A DISPLAY PANEL, AND DISPLAY DEVICE

CROSS-REFERENCE TO RELATED APPLICATION

This application claims priority to Chinese Patent Application No. 202110003233.7 filed Jan. 4, 2021, the disclosure of which is incorporated herein by reference in its entirety.

FIELD

Embodiments of the present disclosure relate to the field of display technologies, and in particular, to a driving method and a driving device of a display panel, and a display device.

BACKGROUND

An organic light emitting diode (OLED) display panel is widely used in the field of photoelectric display due to its advantages of low energy consumption, low manufacturing cost, self-illumination, wide viewing angle, fast response speed, and the like.

The OLED display panel typically includes red, green and blue sub-pixels, each sub-pixel includes an organic light emitting element, and organic light emitting elements of the sub-pixels of different colors are made of different light emitting materials. Moreover, energy bands of different light emitting materials are different, resulting in different working voltages of the sub-pixels of different colors. An organic light emitting element of a sub-pixel with a lower working voltage can emit light with only a less driving current. Therefore, when a sub-pixel with a higher working voltage of adjacent sub-pixels is controlled to emit light and a sub-pixel with a lower working voltage is controlled not to emit light, a driving current of an organic light emitting element of the sub-pixel with the higher working voltage flows to the sub-pixel with the lower working voltage through an interconnected common layer, the sub-pixel with lower working voltage emits light (hereinafter referred to as the sub-pixels being unexpectedly lighted), and the problem of sub-pixels being unexpectedly lighted is more apparent under a low gray scale, thus causing color cast of the display panel, and affecting the display effect of the display panel.

SUMMARY

In view of the above problems, embodiments of the present disclosure provide a driving method and a driving device of a display panel, and a display device, to improve the phenomenon of sub-pixels being unexpectedly lighted and color cast with a lower gray scale, and improving the display effect of the display panel.

In some embodiments of the present disclosure provide a driving method of the display panel. A display panel includes a display region, the display region includes at least one sub-display region, and each of the at least one sub-display region includes at least one pixel unit. Each of the at least one pixel unit includes a plurality of sub-pixels having different light emitting colors. Each of the sub-pixels includes an organic light emitting element. Sub-pixels of the each of the at least one pixel unit includes at least one first sub-pixel and at least one second sub-pixel. The at least one second sub-pixel includes a sub-pixel having at least one light emitting color different from a light emitting color of the at least one first sub-pixel, and a working voltage of the at least one first sub-pixel is less than a working voltage of the at least one second sub-pixel. The driving method of the display panel includes steps described below.

Gray scale data of a pre-display image is acquired. The gray scale data includes gray scale values in one-to-one correspondence with sub-pixels.

According to the gray scale data, a sub-display region in which all gray scale values of first sub-pixels are all 0 and all gray scale value of second sub-pixels are all less than a first preset gray scale value is determined as a first sub-display region, and a sub-display region in which not all of the gray scale values of the first sub-pixels are 0 and not all of the gray scale values of the second sub-pixels are less than the first preset gray scale value is determined as a second sub-display region.

In a reset stage, a first reset signal is provided to an anode of an organic light emitting element of a sub-pixel of the first sub-display region and a second reset signal is provided to an anode of an organic light emitting element of a sub-pixel of the second sub-display region. A voltage of the first reset signal is less than a voltage of the second reset signal.

In some embodiments of the present disclosure provide a driving device of the display panel. A display panel includes a display region, the display region includes at least one sub-display region, and each of the at least one sub-display region includes at least one pixel unit. Each of the at least one pixel unit includes a plurality of sub-pixels having different light emitting colors. Each of the sub-pixels includes an organic light emitting element. The sub-pixels of the each of the at least one pixel unit includes at least one first sub-pixel and at least one second sub-pixel. The at least one second sub-pixel includes a sub-pixel having at least one light emitting color different from a light emitting color of the at least one first sub-pixel, and a working voltage of the at least one first sub-pixel is less than a working voltage of the at least one second sub-pixel. The driving device of the display panel includes a gray scale acquisition device, a sub-display region determination device, and a reset voltage providing device.

The gray scale acquisition device is configured to acquire gray scale data of a frame of display image. The gray scale data includes gray scale values in one-to-one correspondence with sub-pixels.

The sub-display region determination device is configured to, according to the gray scale data, determine a sub-display region in which all gray scale value of first sub-pixels are all 0 and all gray scale values of second sub-pixels are all less than a first preset gray scale value as a first sub-display region, and determine a sub-display region in which not all of the gray scale values of the first sub-pixels is 0 and not all of the gray scale values of the second sub-pixels are less than the first preset gray scale value as a second sub-display region.

The reset voltage providing device is configured, to in a reset stage, provide a first reset signal to an anode of an organic light emitting element of a sub-pixel of the first sub-display region and a second reset signal to an anode of an organic light emitting element of a sub-pixel of the second sub-display region. A voltage of the first reset signal is less than a voltage of the second reset signal.

In some embodiments of the present disclosure further provide a display device. The display device includes a display panel and a driver chip.

The display panel includes a display region, the display region includes at least one sub-display region, and each of the at least one sub-display region includes at least one pixel unit. Each of the at least one pixel unit includes a plurality of sub-pixels having different light emitting colors. Each of the sub-pixels includes an organic light emitting element. The sub-pixels of the each of the at least one pixel unit includes at least one first sub-pixel and at least one second sub-pixel. The at least one second sub-pixel includes a sub-pixel having at least one light emitting color different from a light emitting color of the at least one first sub-pixel. A working voltage of the at least one first sub-pixel is less than a working voltage of each of the at least one second sub-pixel.

The driver chip is configured to execute the method for driving the display panel.

Embodiments of the present disclosure provide the driving method and the driving device of the display panel, and the display device. In the reset stage, a lower first reset signal is provided to the anode of the organic light emitting element of the sub-pixel in the first sub-display region, and all the gray scale value of the first sub-pixels are 0 and all the gray scale values of the second sub-pixels in the first sub-display region are less than the first preset gray scale value. In this way, the first sub-pixel of the first sub-display region requires a greater driving current or longer time for the anode of the first sub-pixel of the first sub-display region to be charged, the working voltage of the first sub-pixel can be reached, so that the first sub-pixel of the first sub-display region is less prone to be unexpectedly lighted, and the phenomenon of color cast caused by the first sub-pixel with the lower working voltage being unexpectedly lighted under the low gray scale is improved, and improving the display effect of the display panel. Meanwhile, when the first sub-pixel itself needs to emit light, the faint light generated due to the sub-pixel being unexpectedly lighted can be ignored; and when the gray scale value of the second sub-pixel is greater than or equal to the first preset gray scale value, it could be considered that the luminous brightness of the luminous sub-pixel in the sub-display region is relatively higher, and the faint light generated due to the sub-pixel being unexpectedly lighted is not apparent and can also be ignored. Therefore, in the reset stage, a greater second reset signal is provided to the anode of the organic light emitting element of the sub-pixel in the second sub-display region, and not all of the gray scale values of the first sub-pixels are 0 and not all of the gray scale values of the second sub-pixels in the second sub-display region are less than the first preset gray scale value. In this way, when the organic light emitting element of the sub-pixel in the second sub-display region emit light, the working voltage of the sub-pixel in the second sub-display region can be ensured to reach in shorter charging time, and light emitting response time of the sub-pixels in the second sub-display region is shortened, and improving the display effect of the display panel. In addition, since the voltages of the first reset signal and the second reset signal are typically negative values and power consumption is generally positively correlated with an absolute value of the voltage, when the voltage of the first reset signal is less than the voltage of the second reset signal, an absolute value of the voltage of the first reset signal is larger than an absolute value of the second reset voltage, so that the power consumption of the display panel can be reduced by providing the second reset signal to the second sub-display region.

DETAILED DESCRIPTION

Figure 1:
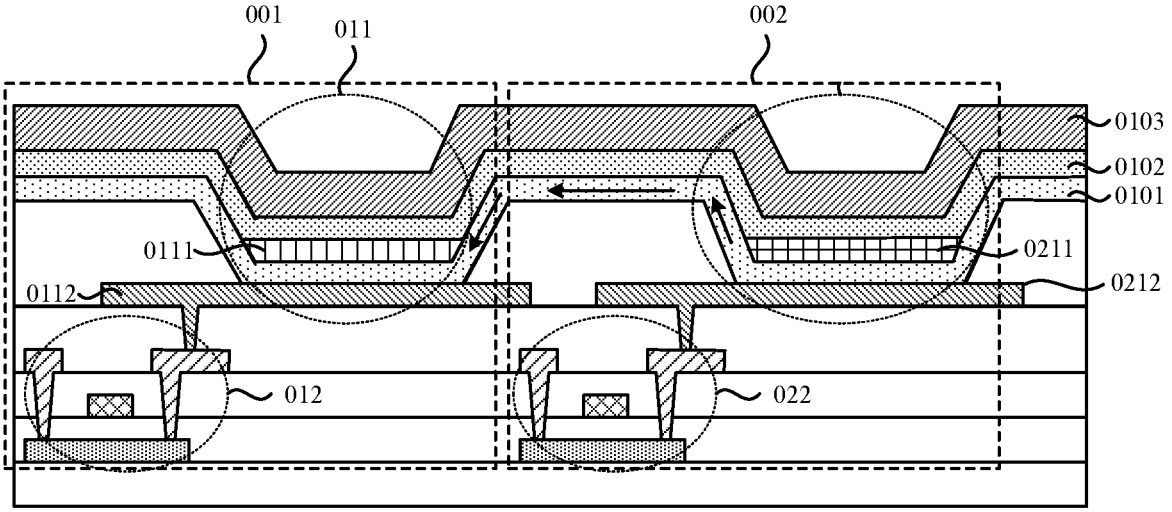
FIG. 1 is a film structure view illustrating a display panel according to the related art.

Hereinafter the present disclosure will be further described in detail in conjunction with the drawings and embodiments. It is to be understood that the embodiments set forth herein are merely intended to illustrate and not to limit the present disclosure. Additionally, it is to be noted that for ease of description, merely part, not all, of the structures related to the present disclosure are illustrated in the drawings.

In the related art, a display panel typically includes three colors, namely, red, green and blue, of sub-pixels, and each sub-pixel unit is provided with an organic light emitting element and a pixel circuit. The organic light emitting element includes an anode, a hole transport layer, a light emitting layer, an electron transport layer and a cathode arranged in sequence. Anodes and the light emitting layers of different organic light emitting elements are independent from each other, and hole transport layers, electron transport layers and cathodes of organic light emitting elements are generally arranged in a respective whole layer. Exemplarily, FIG. 1 is a film structure view of a display panel according to the related art. As shown in FIG. 1, a sub-pixel 001 and a sub-pixel 002 having different color from the sub-pixel 001 in the display panel are described as an example. The sub-pixel 001 includes an organic light emitting element 011 and a pixel circuit 012, and the sub-pixel 002 includes an organic light emitting element 021 and a pixel circuit 022. A light emitting layer 0111 of the organic light emitting element 011 is independent from, and not connected to a light emitting layer 0211 of the organic light emitting element 021, and an anode 0112 of the organic light emitting element 011 is independent from, and not connected to an anode 0212 of the organic light emitting element 021. The organic light emitting element 011 and the organic light emitting element 012 share a cathode 0103, a hole transport layer 0101, and an electron transport layer 0102, where the hole transport layer 0101 and the electron transport layer 0102 are typically referred to as a common layer. Moreover, when one of the sub-pixels, such as the sub-pixel 002, emits light, carriers in the organic light emitting element 021 transversely migrate to the organic light emitting element 011 adjacent to the organic light emitting element 021 through the common layer.

Since the organic light emitting element may be equivalent to a capacitor and a diode, when the organic light emitting element emits light, the capacitor needs to be charged to a working voltage of the capacitor, the organic light emitting element can emit light, and the lower the working voltage of the organic light emitting element, the easier the organic light emitting element is to emit light. Exemplarily, a working voltage of the organic light emitting element 011 in the sub-pixel 001 being lower than a working voltage of the sub-pixel 002 is described as an example. When the carriers in the organic light emitting element 021 transversely migrate to the organic light emitting element 011 adjacent to the organic light emitting element 021 through the common layer, since the working voltage of the organic light emitting element 011 is lower, lesser carriers can cause the organic light emitting element 011 to emit faint light, and causing the sub-pixel being unexpectedly lighted and affecting the display effect of the display panel. Especially under the low gray scale, luminous brightness of each sub-pixel is lower, so that the faint light is more apparent. In this way, the display panel is to display the light emitting color of the organic light emitting element 011, and causing the display panel to generate color cast and affecting the display quality of the display panel.

Embodiments of the present disclosure provide a driving method of the display panel. The driving method may be executed by a driver chip, and the driver chip is configured to drive the display panel provided by the embodiments of the present disclosure. The display panel includes a display region, the display region includes at least one sub-display region, and each of the at least one sub-display region includes at least one pixel unit. Each of the at least one pixel unit includes a plurality of sub-pixels having different light emitting colors. Each of sub-pixels includes an organic light emitting element. The each of the at least one pixel unit includes at least one first sub-pixel and at least one second sub-pixel. The at least one second sub-pixel includes a sub-pixel having at least one light emitting color different from a light emitting color of the at least one first sub-pixel, and a working voltage of the at least one first sub-pixel is less than a working voltage of each of the at least one second sub-pixel.

Figure 2:
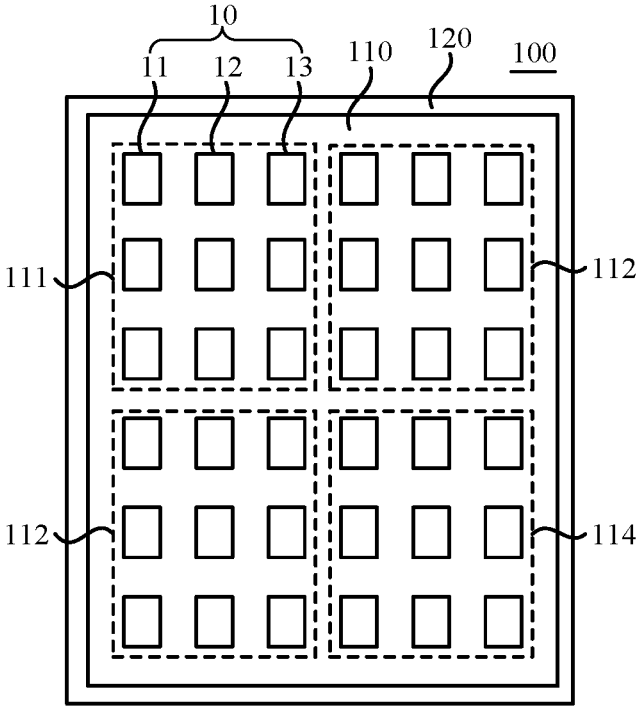
FIG. 2 is a structure view of a display panel according to an embodiment of the present disclosure.
Figure 3:
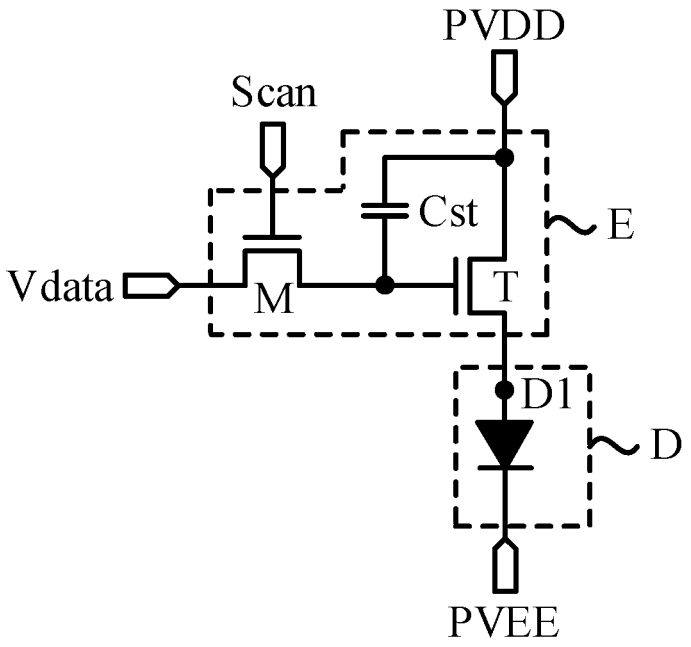
FIG. 3 is a structure view of a sub-pixel according to an embodiment of the present disclosure.

In an embodiment, FIG. 2 is a structure view of a display panel according to an embodiment of the present disclosure; and FIG. 3 is a structure view of a sub-pixel according to an embodiment of the present disclosure. In conjunction with FIG. 2 and FIG. 3, the display panel 100 includes a display region 110 and a non-display region 120 surrounding the display region 110. The display region 110 includes at least one sub-display region. In an embodiment, the display region 110 may include four sub-display regions 111, 112, 113 and 114. Each of the sub-display regions 111, 112, 113 and 114 includes at least one pixel unit 10, each pixel unit 10 includes a first sub-pixel 11 and two second sub-pixels 12 and 13, and the first sub-pixel 11, the second sub-pixel 12, and the second sub-pixel 13 each have a different light emitting color. When the sub-pixels 11, 12 and 13 having different light emitting colors in each pixel unit 10 display and emit light, the display panel 100 can present an image with rich colors. Each of the sub-pixels 11, 12 and 13 includes an organic light emitting element D and a pixel driving circuit E. The pixel driving circuit E may include a driving transistor T, a storage capacitor Cst and at least one switching transistor M. The switching transistor M is controlled to be turned on by a scanning signal Scan so that a data signal Vdata can be written to a gate of the driving transistor T through the turned-on switching transistor M and stored in the storage capacitor Cst. When the organic light emitting element D displays, a current path is formed between a positive power supply voltage signal PVDD and a negative power supply voltage signal PVEE, so that the driving transistor T provides a driving current to the organic light emitting element D according to the data signal Vdata written to the gate of the driving transistor T. Since the organic light emitting element D can be equivalent to the capacitor and the diode, the organic light emitting element D needs to be charged to a working voltage of the organic light emitting element D before the organic light emitting element D emits light, the organic light emitting element D can emit light. Generally, the lower the working voltage of the sub-pixel, the easier the working voltage at which the organic light emitting element D in the sub-pixel emits light is to reach. When the working voltage of the first sub-pixel 11 is lower than the working voltages of the second sub-pixels 12 and 13, the first sub-pixel 11 emits light more easily than the second sub-pixels 12 and 13.

It is to be noted that FIG. 2 is only an exemplary drawing of an embodiment of the present disclosure. FIG. 2 exemplarily shows that display region 110 of the display panel 100 includes four sub-display regions 111, 112, 113 and 114. Moreover, the display region of the display panel in the embodiments of the present disclosure may include at least one sub-display region, that is, may include one, two or more sub-display regions, and the number of sub-display regions included in the display region is not limited in the embodiments of the present disclosure.

Similarly, FIG. 3 is also an exemplary drawing of an embodiment of the present disclosure. FIG. 3 only exemplarily shows that the pixel driving circuit of each sub-pixel has a structure of 2T1C (that is, two transistors and one capacitor). Moreover, in the embodiments of the present disclosure, the pixel driving circuit of each sub-pixel may include multiple transistors, multiple capacitors, and other components, which is not limited in the embodiments of the present disclosure.

Figure 4:
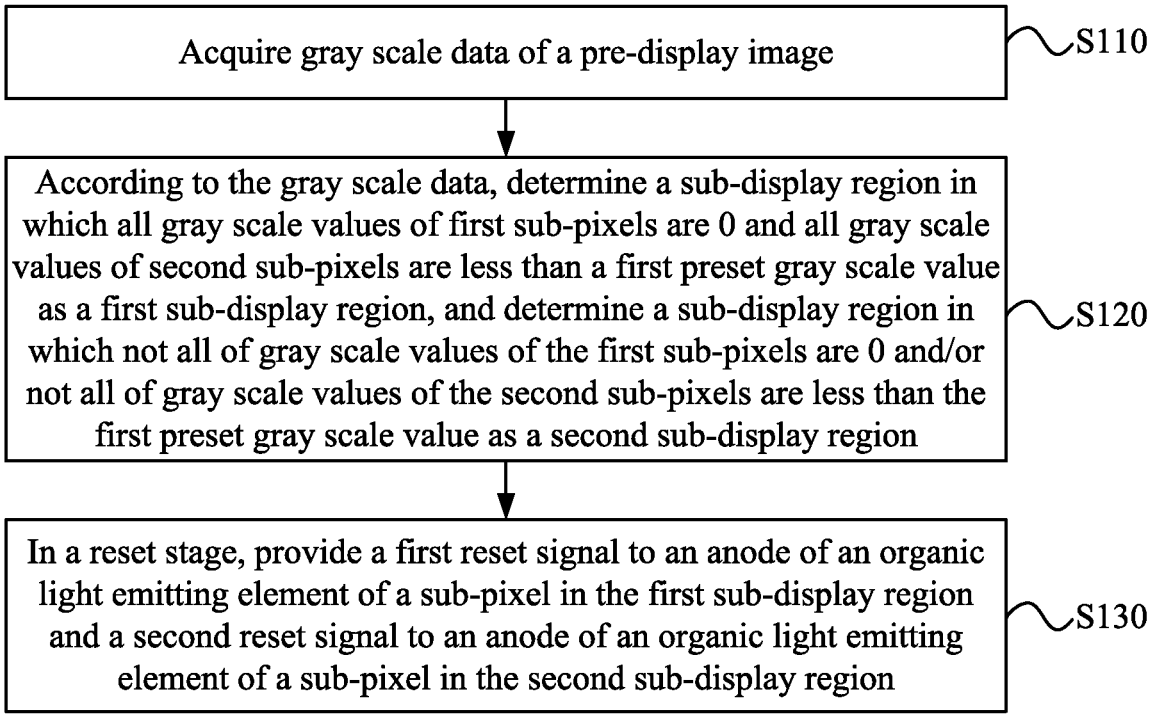
FIG. 4 is a flowchart of a driving method of a display panel according to an embodiment of the present disclosure.

FIG. 4 is a flowchart of a driving method of a display panel according to an embodiment of the present disclosure. As shown in FIG. 4, the driving method of the display panel includes steps described below.

In S110, gray scale data of a pre-display image is acquired.

Gray scale data of each frame of display image includes gray scale values in one-to-one correspondence with sub-pixels in the display panel. The gray scale value represents the brightness level that the sub-pixel displays, that is, the higher the gray scale value, the higher the luminous brightness of the sub-pixel, and the lower the gray scale value, the lower the luminous brightness of the sub-pixel. For sub-pixels of a same color, different gray scale values correspond to different data signals, that is, when a frame of display image is displayed, a corresponding data signal can be provided to the sub-pixel according to the gray scale value of the sub-pixel in the frame of display image, the organic light emitting element of the sub-pixel can have corresponding luminous brightness.

In S120, according to the gray scale data, a sub-display region in which all gray scale values of first sub-pixels are 0 and all gray scale values of second sub-pixels are less than a first preset gray scale value is determined as a first sub-display region; and a sub-display region in which not all of gray scale values of the first sub-pixels are 0 and/or not all of gray scale values of the second sub-pixels are less than the first preset gray scale value is determined as a second sub-display region.

In an embodiment, the higher the gray scale value, the higher the luminous brightness of the sub-pixel; and the lower the gray scale value, the lower the luminous brightness of the sub-pixel. Therefore, when the gray scale values of the sub-pixels in the display panel vary from 0 to 255, the luminous brightness of the organic light emitting element in the sub-pixel with the gray scale value of 0 is the darkest, or it could be considered that the organic light emitting element in the sub-pixel with the gray scale value of 0 does not emit light. Correspondingly, the first preset gray scale value may be set according to requirements, and a value range of the first preset gray scale value P may be, for example, $25 \leq p \leq 35$. For example, the first preset gray scale value may be 30. At this time, a gray scale value less than the first preset gray scale value may be considered as a low gray scale value, and a gray scale value greater than or equal to the first preset gray scale value may be considered as a non-low gray scale value. At this time, the sub-display region in which each first sub-pixel does not emit light and the gray scale value of each second sub-pixel is the low gray scale may be considered as a low gray scale sub-display region, and the low gray scale sub-display region is determined as the first sub-display region; and the sub-display region in which the gray scale value of the second sub-pixel is not less than the first preset gray scale value, the sub-display region having a luminous first sub-pixel, and the sub-display region in which not all of the gray scale values of the second sub-pixels are less than the first preset gray scale value and not all of the gray scale values of the first sub-pixels are 0 are all determined as the second sub-display region. When the display region of the display panel includes only one sub-display region, the sub-display region can only be one of the first sub-display region and the second sub-display region. When the display region of the display panel includes two or more sub-display regions, both the first sub-display region and the second sub-display region can exist. In one embodiment, when the display region of the display panel includes two or more sub-display regions, all of the sub-display regions may be the first sub-display region, or all of the sub-display regions may be the second sub-display region.

In S130, in the reset stage, a first reset signal is provided to an anode of an organic light emitting element of a sub-pixel in the first sub-display region and a second reset signal is provided to an anode of an organic light emitting element of a sub-pixel in the second sub-display region.

In an embodiment, the reset stage of the sub-pixel is typically a non-luminous stage of the sub-pixel. After one light emitting stage of the sub-pixel is finished and before a next light emitting stage of the sub-pixel is started, a reset signal is provided to the anode of the organic light emitting element of the sub-pixel, to reset the anode of the organic light emitting element of the sub-pixel and prevent the last light emitting stage from affecting the luminous brightness of the sub-pixel in the next light emitting stage. In addition, when the organic light emitting element of the sub-pixel emits light, a potential of the anode of the organic light emitting element needs to be charged to a potential capable of emitting light, that is, to reach the working voltage of the sub-pixel, the organic light emitting element of the sub-pixel can emit light. A voltage of the first reset signal provided to the first sub-display region is less than a voltage of the second reset signal provided to the second sub-display region. That is to say, a less reset voltage is provided to the sub-display region in which the gray scale value of each second sub-pixel is the low gray scale value and each first sub-pixel does not emit light, and a greater reset voltage is provided to the sub-display region in which the first sub-pixel emits light and/or the gray scale value of each second sub-pixel is the non-low gray scale value.

In an embodiment, the display panel shown in FIG. 2 and the sub-pixel shown in FIG. 3 are described as an example. Since the working voltage of the first sub-pixel 11 is less than the working voltage of each of the second sub-pixels 12 and 13, the organic light emitting element D of the first sub-pixel 11 is more easily to emit light. At this time, a gray scale value corresponding to each of the sub-pixels 11, 12 and 13 in the display panel 100 can be determined according to the gray scale data of the pre-display image. When the gray scale value of each first sub-pixel 11 in one sub-display region of the display panel 100 is 0, that is, each first sub-pixel 11 in the sub-display region does not emit light, and the gray scale value of each second sub-pixel 12 and 13 in the sub-display region is less than the first preset gray scale value, that is, the gray scale value of each second sub-pixel 12 and 13 in the sub-display region is the low gray scale value, the sub-display region can be determined as the first sub-display region; and the first reset signal with a less voltage is provided to the anode D1 of the organic light emitting element D of each sub-pixel 11, 12 and 13 of the first sub-display region in the reset stage. In this way, the anode D1 of each organic light emitting element D of the first sub-display region has a lower potential. When the organic light emitting element D of the first sub-display region emits light, a greater driving current is required to charge the anode D1 of the organic light emitting element D of the first sub-display region to the potential capable of emitting light. In this way, when the pixel driving circuit E of each second sub-pixel 12 and 13 of the first sub-display region provides a driving current to the organic light emitting element D of each second sub-pixel 12 and 13 according to a data signal corresponding to the gray scale value of each second sub-pixel 12 and 13, even if the current in the organic light emitting element D of each second sub-pixel 12 and 13 flows to the organic light emitting element D of the first sub-pixel 11 through the common layer, the organic light emitting element D of the first sub-pixel 11 cannot emit light or the organic light emitting element D of the first sub-pixel 11 cannot be charged to the voltage required to emit light within a short period of time. Therefore, the situation of the pixel being unexpectedly lighted in the low gray scale sub-display region can be improved and color cast caused by the pixel being unexpectedly lighted can be prevented, and improving the display effect of the display panel 100.

Meanwhile, when the first sub-pixel 11 itself needs to emit light, the faint light generated due to the sub-pixel being unexpectedly lighted can be ignored; and when the gray scale value of the second sub-pixel 12 and 13 is greater than or equal to the first preset gray scale value, it could be considered that the luminous brightness of the luminous sub-pixel in the sub-display region is relatively higher, the faint light generated due to the sub-pixel being unexpectedly lighted is not apparent, and the faint light has little influence on the overall light emitting color of the sub-display region and can also be ignored. Therefore, when the display region 110 of the display panel 100 includes a sub-display region in which the first sub-pixel 11 does not emit light and/or not all of the gray scale values of the second sub-pixels 12 and 13 are less than 0, and the sub-display region may be determined as the second sub-display region. In addition, in the reset stage of each sub-pixel in the second sub-display region, a second reset signal with a greater voltage is provided to the anode D1 of the organic light emitting element D of each sub-pixel 11, 12 and 13 in the second sub-display region, when the organic light emit element D of each sub-pixel 11, 12 and 13 in the second sub-display region emits light, the organic light emitting element D of each sub-pixel 11, 12 and 13 in the second sub-display region can be charged to a voltage required to emit light in a relatively short period of time. In this way, the light emitting response time of each sub-pixel 11, 12 and 13 in the second sub-display region can be shortened, and improving the display quality of the display panel 100.

In addition, since the voltage of the first reset signal and the voltage of the second reset signal are typically negative values, and power consumption is generally positively correlated with an absolute value of the voltage, when the voltage of the first reset signal is less than the voltage of the second reset signal, an absolute value of the voltage of the first reset signal is greater than an absolute value of the second reset voltage. Therefore, the power consumption of the display panel can be reduced by providing the second reset signal to the second sub-display region.

Figure 5:
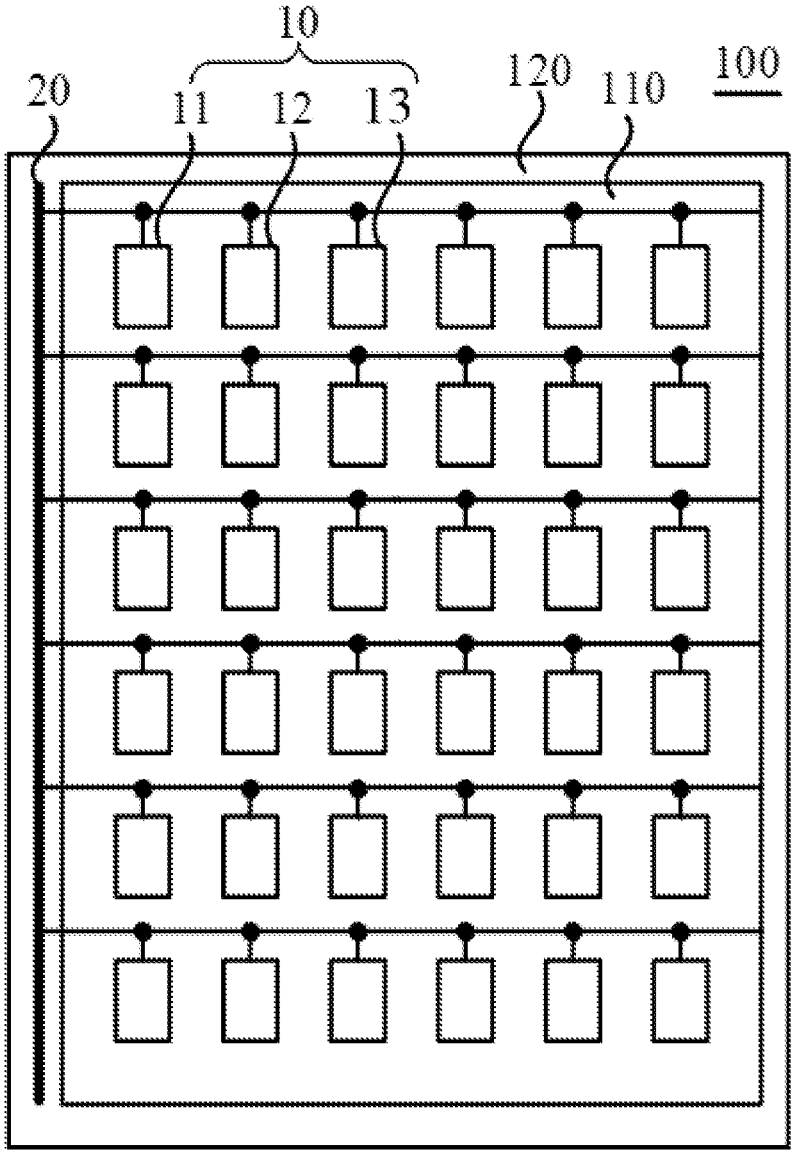
FIG. 5 is a structure view of another display panel according to an embodiment of the present disclosure.

It is to be understood that when the display panel includes only one sub-display region, the first reset signal or the second reset signal may be provided to each sub-pixel of the display panel in the reset stage according to the gray scale data of each frame of display image. At this time, as shown in FIG. 5, only one reset signal bus 20 may be provided in the display panel 100 to transmit the first reset signal or the second reset signal to each sub-pixel 11, 12 and 13 through the reset signal bus 20 in the reset stage.

Figure 6:
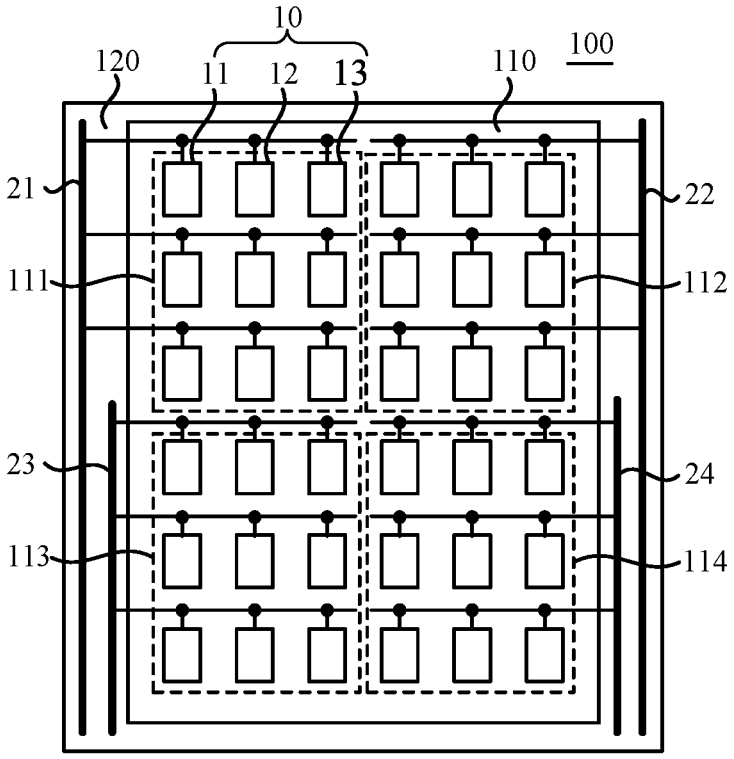
FIG. 6 is a structure view of another display panel according to an embodiment of the present disclosure.

In an embodiment, as shown in FIG. 6, when the display region 110 of the display panel 100 includes a plurality of sub-display regions 111, 112, 113 and 114, the reset signal buses 21, 22, 23 and 24 may be provided in one-to-one correspondence with the sub-display regions 111, 112, 113 and 114. That is to say, sub-pixels 11, 12 and 13 in the sub-display region 111 are electrically connected to a reset signal bus 21, sub-pixels 11, 12 and 13 in the sub-display region 112 are electrically connected to a reset signal bus 22, sub-pixels 11, 12 and 13 in the sub-display region 113 are electrically connected to a reset signal bus 23, and sub-pixels 11, 12 and 13 in the sub-display region 114 are electrically connected to a reset signal bus 24. In this way, the first reset signal or the second reset signal is transmitted to the sub-pixels 11, 12 and 13 in the sub-display region 111 through the reset signal bus 21 in the reset stage of the sub-pixels 11, 12 and 13 in the sub-display region 111, the first reset signal or the second reset signal is transmitted to the sub-pixels 11, 12 and 13 in the sub-display region 112 through the reset signal bus 22 in the reset stage of the sub-pixels 11, 12 and 13 in the sub-display region 112, the first reset signal or the second reset signal is transmitted to the sub-pixels 11, 12 and 13 in the sub-display region 113 through the reset signal bus 23 in the reset stage of the sub-pixels 11, 12 and 13 in the sub-display region 113, and the first reset signal or the second reset signal is transmitted to the sub-pixels 11, 12 and 13 in the sub-display region 114 through the reset signal bus 24 in the reset stage of the sub-pixels 11, 12 and 13 in the sub-display region 114.

Correspondingly, when the pixel driving circuit of each sub-pixel has a 2T1C structure as shown in FIG. 3, the first reset signal or the second reset signal may be simultaneously provided to the anode of the organic light emitting element of each sub-pixel of each sub-display region before the data signal is written into each sub-pixel and/or before each sub-pixel emits light, that is, the sub-pixels have a same reset stage. However, the structure of the pixel driving circuit in the embodiments of the present disclosure is not limited to the pixel driving circuit shown in FIG. 3, that is, the pixel driving circuit of each sub-pixel may further be in other forms. For example, the pixel driving circuit of each sub-pixel may further include a reset transistor, and each reset transistor is controlled to be turned on or off through a corresponding scanning signal; and when the reset transistor is turned on, the first reset signal or the second reset signal may be written into the anode of the organic light emitting element, and at this time, the anode of the organic light emitting element of each sub-pixel can be reset according to a row or column of the sub-pixels.

Figure 7:
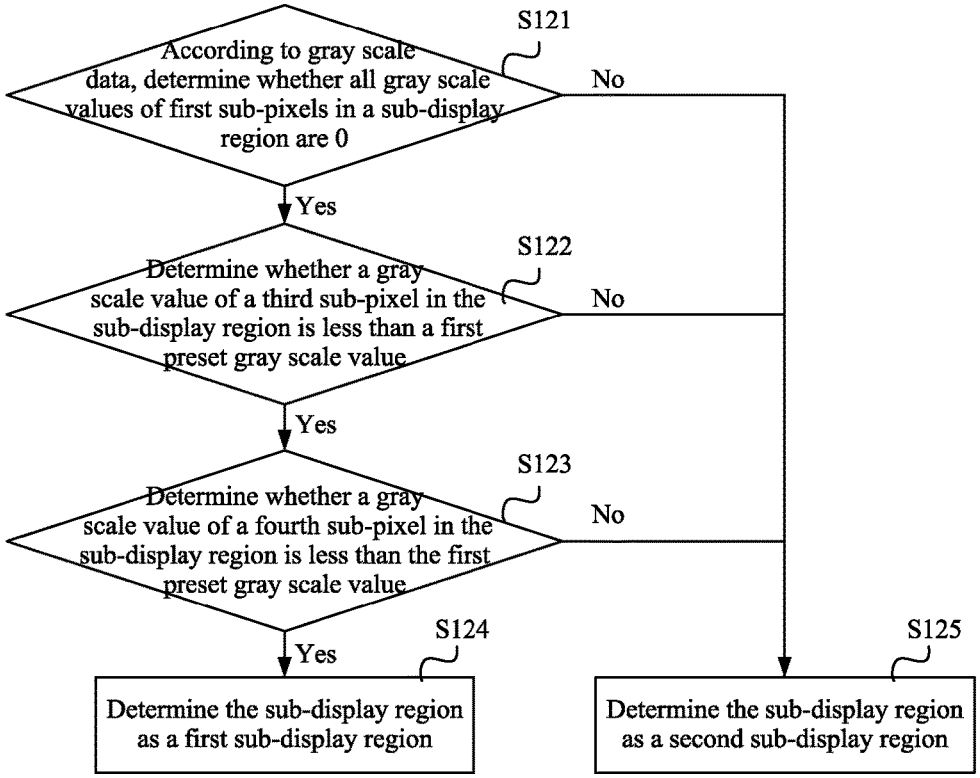
FIG. 7 is a flowchart of a method for determining a sub-display region according to an embodiment of the present disclosure.

In an embodiment, if at least one second sub-pixel in each pixel unit includes a third sub-pixel having a second light emitting color and a fourth sub-pixel having a third light emitting color, and a working voltage of the third sub-pixel is less than a working voltage of the fourth sub-pixel, gray scale voltages of the third sub-pixel and the fourth sub-pixel shall be sequentially considered when the first sub-display region and the second sub-display region are determined. FIG. 7 is a flowchart of a method for determining a sub-display region according to an embodiment of the present disclosure. As shown in FIG. 7, the method for determining the sub-display region includes steps described below.

In S121, whether all the gray scale value of first sub-pixels in a sub-display region are 0 is determined according to the gray scale data; if yes, S122 is executed; and if no, S125 is executed.

In S122, whether a gray scale value of the third sub-pixel in the sub-display region is less than the first preset gray scale value is determined; if yes, S123 is executed; and if no, S125 is executed.

In S123, whether a gray scale value of the fourth sub-pixel in the sub-display region is less than the first preset gray scale value is determined; if yes, S124 is executed; and if no, S125 is executed.

In S124, the sub-display region is determined as the first sub-display region.

In S125, the sub-display region is determined as the second sub-display region.

In an embodiment, the display panel shown in FIG. 2 is still described as an example. Each pixel unit 10 may include a first sub-pixel 11, a third sub-pixel 12, and a fourth sub-pixel 13. Since a working voltage of the first sub-pixel 11 is less than a working voltage of the third pixel 12 and a working voltage of the fourth sub-pixel 13, and the working voltage of the third sub-pixel 12 is less than the working voltage of the fourth sub-pixel 13, the first sub-pixel 11 is more prone to be unexpectedly lighted than the third sub-pixel 12 and the fourth sub-pixel 13, and the third sub-pixel 12 is more prone to be unexpectedly lighted than the fourth sub-pixel 13. Therefore, when the first sub-display region and the second sub-display region are determined, gray scale data of the first sub-pixel 11, gray scale data of the third sub-pixel 12 and gray scale data of the fourth sub-pixel 13 may be sequentially considered.

In an embodiment, the sub-display region 111 is described as an example. Whether all the gray scale values of the first sub-pixels 11 in the sub-display region 111 are 0 may be considered, and when the sub-display region 111 has a first sub-pixel 11 where gray scale value of the first sub-pixel 11 is not 0, the sub-display region 111 may be directly determined as the second sub-display region. When all the gray scale values of the first sub-pixels 11 in the sub-display region 111 are 0, whether all the gray scale values of the third sub-pixels 12 in the sub-display region 111 are less than the first preset gray scale value is further considered, that is to say, whether all the gray scale values of the third sub-pixels 12 in the sub-display region 111 are within the range of the low gray scale value. If the sub-display region 111 has a third sub-pixel 12 where gray scale value of the third sub-pixel 12 is not within the range of the low gray scale value, the sub-display region 111 is considered as the non-low gray scale sub-display region, and the sub-display region 111 can be directly determined as the second sub-display region. When all the gray scale values of the third sub-pixels 12 in the sub-display region 111 are within the range of low gray scale value, whether all the gray scale values of the fourth sub-pixels 13 in the sub-display region 111 are less than the first preset gray scale value is further considered, that is to say, whether all the gray scale values of the fourth sub-pixels 13 in the sub-display region 111 are within the range of the low gray scale value. If the sub-display region 111 has a fourth sub-pixel 13 where gray scale value of the fourth sub-pixel 13 is not within the range of the low gray scale value, the sub-display region 111 is considered as the non-low gray scale sub-display region, and the sub-display region 111 can be directly determined as the second sub-display region. When all the gray scale values of the fourth sub-pixels 13 in the sub-display region 111 are within the range of low gray scale value, that is, all the gray scale values of the first sub-pixels 11 are 0, all the gray scale values of the third sub-pixels 12 and all the gray scale values of the fourth sub-pixels 13 are within the range of the low gray scale value, the sub-display region 111 is considered to be the low gray scale sub-display region that the pixel being unexpectedly lighted and color cast are prone to occur, and the sub-display region 111 can be directly determined as the first sub-display region.

In this way, the gray scale value of the first sub-pixel 11, the gray scale value of the third sub-pixel 12, and the gray scale value of the fourth sub-pixel 13 are sequentially considered according to magnitudes of the working voltage of the first sub-pixel 11, the working voltage of the third sub-pixel 12, and the working voltage of the fourth sub-pixel 13, and the first sub-display region and the second sub-display region are determined correspondingly. In this way, on the premise that the condition of the sub-pixel being unexpectedly lighted is improved and the display uniformity of the sub-display regions of the display panel is improved, the organic light emitting element of each sub-pixel in the non-low gray scale sub-display region having shorter light emitting response time can be ensured, and improving the display quality of the display panel.

It is to be noted that since the sub-pixels of different light emitting colors are made of different materials, sub-pixels of different light emitting colors have different working voltages. Generally, the working voltage of the sub-pixel with red light emitting color is less, followed by the working voltage of the sub-pixel with green light emitting color, and the working voltage of the sub-pixel with blue light emitting color is larger. Therefore, the light emitting color of the first sub-pixel may be red, the light emitting color of the third sub-pixel may be green, and the light emitting color of the fourth sub-pixel may be blue. However, when the working voltages of the sub-pixels of different light emitting colors are in other conditions, the light emitting colors of the first sub-pixel, the third sub-pixel and the fourth sub-pixel may also be in other forms, which are not limited in the embodiments of the present disclosure.

Figure 8:
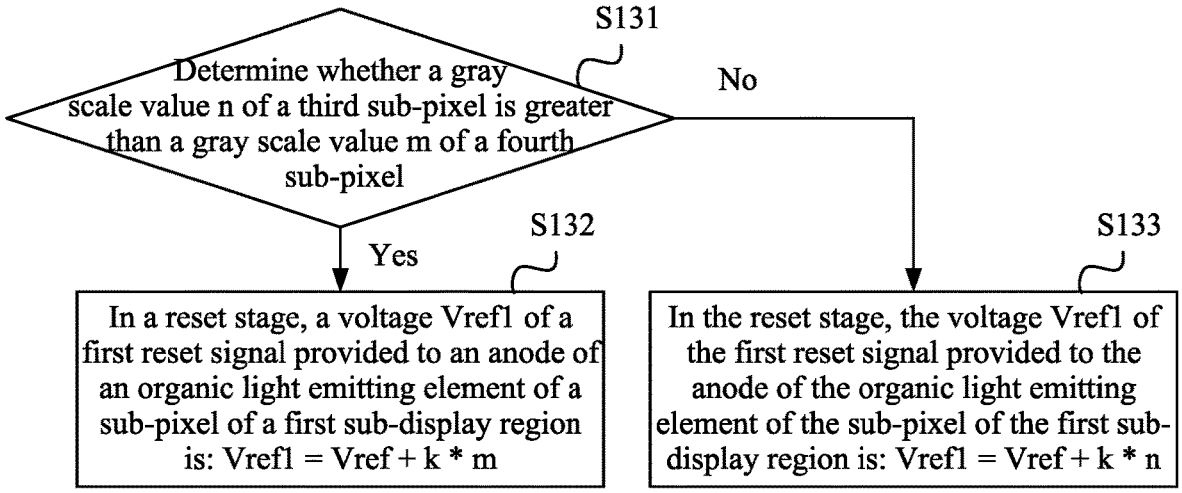
FIG. 8 is a flowchart of a method for providing a reset signal to a first sub-display region according to an embodiment of the present disclosure.

In an embodiment, if at least one second sub-pixel in each pixel unit includes a third sub-pixel having a second light emitting color and a fourth sub-pixel having a third light emitting color, a corresponding first reset signal may be provided to each sub-pixel in the first sub-display region according to the gray scale value of the third sub-pixel or the fourth sub-pixel in the first sub-display region in the reset stage. FIG. 8 is a flowchart of a method for providing a reset signal to a first sub-display region according to an embodiment of the present disclosure. As shown in FIG. 8, the method for providing the reset signal to the first sub-display region includes steps described below.

In S131, whether a gray scale value n of the third sub-pixel is greater than a gray scale value m of the fourth sub-pixel is determined; if yes, S132 is executed; and if no, S133 is executed.

In S132, in the reset stage, a voltage Vref1 of the first reset signal provided to the anode of the organic light emitting element of the sub-pixel of the first sub-display region is: $Vref1=Vref+k\times m$.

In S133, in the reset stage, a voltage Vref1 of the first reset signal provided to the anode of the organic light emitting element of the sub-pixel of the first sub-display region is: $Vref1=Vref+k\times n$.

In an embodiment, still referring to FIG. 2, when all the gray scale values of the first sub-pixels 11 in the sub-display region 111 are 0 and the gray scale values of the third sub-pixel 12 and the fourth sub-pixel 13 are less than the first preset gray scale value, a first reset signal with a less voltage may be provided to the sub-display region 111. At this time, the voltage of the first reset signal may be related to the gray scale value of the third sub-pixel 12 or the gray scale value of the fourth sub-pixel 13. That is to say, when the gray scale value of the third sub-pixel 12 is less than the gray scale value of the fourth sub-pixel 13, the voltage of the first reset signal may be related to the gray scale value of the third sub-pixel 12; and when the gray scale value of the third sub-pixel 12 is not less than the gray scale value of the fourth sub-pixel 13, the voltage of the first reset signal may be related to the gray scale value of the fourth sub-pixel 13. In this way, the voltage of the first reset signal is related to the gray scale value of the third sub-pixel 12 having a less gray scale value or the gray scale value of the fourth sub-pixel 13 having a less gray scale value to reduce the power consumption of the display panel as much as possible on the premise that the sub-pixel being unexpectedly lighted is improved. In the voltage calculation formula of the first reset signal, Vref is a fixed voltage and k is a correlation coefficient.

In an embodiment, the case where Vref is −5V, a value range of k is $0.1\leq k\leq 0.2$, for example, k is equal to 0.1, and the first preset gray scale value is 30 is described as an example. The relationship between the voltage value of the first reset signal and the third sub-pixel or the fourth sub-pixel is shown in Table 1.

| min(n, m) | First reset signal Vref1/V |
|---|---|
| 29 | −2.1 |
| 28 | −2.2 |
| 27 | −2.3 |
| 26 | −2.4 |
| 25 | −2.5 |
| 24 | −2.6 |
| 23 | −2.7 |
| 22 | −2.8 |
| 21 | −2.9 |
| 20 | −3 |
| . . . | . . . |
| 0 | −5 |

Where, n is the gray scale value of the third sub-pixel, and m is the gray scale value of the fourth sub-pixel. It could be seen that when the gray scale value of a sub-pixel with a less gray scale value between the third sub-pixel and the fourth sub-pixel changes from 0 to 29, the voltage of the first reset signal also increases from −5 to −2.1 successively.

Correspondingly, since the phenomenon of color cast caused by unexpected lighting of sub-pixels in the second sub-display region in which not all the gray scale values of the first sub-pixels are 0 and/or not all the gray scale values of the second sub-pixels are less than the first preset gray scale value is not apparent, a second reset signal with a greater voltage may be provided to the anodes of the organic light emitting elements of the sub-pixels in the second sub-display region, and the voltage Vref2 of the second reset signal may be Vref2=Vref+k×p, where p is the first preset gray scale value. For example, when p is 30, Vref is −5, and k is 0.1, the voltage of the second reset signal may be −2.

It is to be understood that the above determination method of the sub-display region 111 is exemplarily described, the determination method of other sub-display regions 112, 113 and 114 in the display panel 100 is similar to the above determination method of the sub-display region 111, and the similarities may be referred to the above determination method of the sub-display region 111 and will not be repeated herein.

Figure 9:
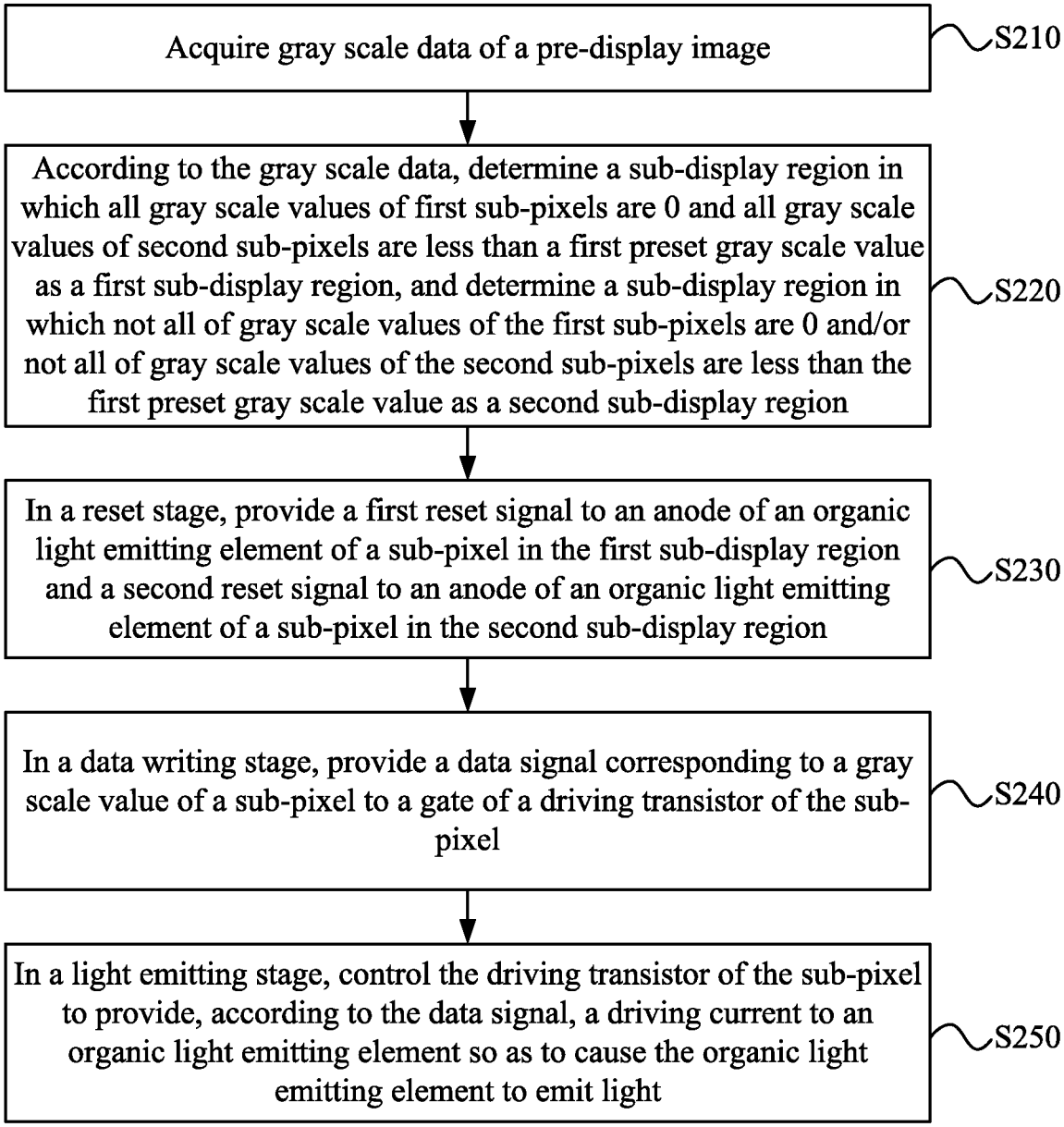
FIG. 9 is a flowchart of another driving method of a display panel according to an embodiment of the present disclosure.

In an embodiment, when each sub-pixel further includes a pixel driving circuit, and the pixel driving circuit at least includes a driving transistor, the driving method of the display panel should further include a data writing stage and a light emitting stage. FIG. 9 is a flowchart of another driving method of a display panel according to an embodiment of the present disclosure. As shown in FIG. 9, the driving method of the display panel includes steps described below.

In S210, gray scale data of a pre-display image is acquired.

In S220, according to the gray scale data, a sub-display region in which all gray scale value of first sub-pixels are 0 and gray scale values of second sub-pixels are less than a first preset gray scale value is determined as a first sub-display region; and a sub-display region in which not all of gray scale values of the first sub-pixels are 0 and/or not all of gray scale values of the second sub-pixels are less than the first preset gray scale value is determined as a second sub-display region.

In S230, in the reset stage, a first reset signal is provided to an anode of an organic light emitting element of sub-pixel in the first sub-display region and a second reset signal is provided to an anode of an organic light emitting element of a sub-pixel in the second sub-display region.

In S240, in a data writing stage, a data signal corresponding to a gray scale value of a sub-pixel is provided to a gate of a driving transistor of the sub-pixel.

In S250, in a light emitting stage, the driving transistor of the sub-pixel is controlled to provide a driving current to the organic light emitting element according to the data signal, to cause the organic light emitting element to emit light.

In an embodiment, since the organic light emitting element is a current-type driving element, while the data signal is typically a voltage signal corresponding to the gray scale value of the sub-pixel, the driving transistor needs to be provided in the pixel driving circuit of each sub-pixel so that the driving transistor converts the data signal into a driving current and then inputs the driving current to the organic light emitting element to control the luminous light level of the organic light emitting element. Meanwhile, when the organic light emitting element emits light, carriers in the organic light emitting element transversely migrate to the adjacent organic light emitting element through the common layer. Therefore, in order to prevent the sub-pixel from being unexpectedly lighted due to the transverse migration of carriers, the reset stage of the sub-pixel needs to be set before the light emitting stage of the sub-pixel, to ensure that when the organic light emitting element emits light and the carriers transversely migrate to the adjacent organic light emitting element, the anode of the adjacent organic light emitting element needs to be first charged from the potential of the first reset signal or the second reset signal to the potential capable of normally emitting light, and improving the phenomenon of unexpected lighting of the adjacent organic light emitting element and improving the display effect of the display panel 100.

It is to be noted that in the above steps, the reset stage is before the data writing stage. However, in this embodiment, the reset stage may be after the data writing stage, or the reset stage and the data writing stage may also be a same stage, which is not limited by the embodiments of the present disclosure.

It is to be understood that when the pixel driving circuit of each sub-pixel is the pixel driving circuit shown in FIG. 3, the switching transistors M of the pixel driving circuits in each row of sub-pixels can be sequentially controlled to be turned on so that data signals corresponding to the gray scale values of each row of sub-pixels can be sequentially written. While before the data signals are written into all the sub-pixels, during the data signals being written into all the sub-pixels, or after the data signals are written into all the sub-pixels, the first reset signal and/or the second reset signal can be correspondingly written to the anodes of the organic light emitting elements in each sub-display region. In addition, when the structure of the pixel driving circuit is in other forms, the data writing stage and the reset stage of each sub-pixel may also be set according to conditions.

In an embodiment, when each sub-pixel includes the pixel driving circuit, and the pixel driving circuit at least includes the driving transistor, an initialization stage may further be included before the data writing stage. In the initialization stage, an initialization signal is provided to the gate of the driving transistor of the sub-pixel, to initialize the driving transistor of the sub-pixel and prevent a data signal written in the last driving period of the sub-pixel affecting the data signal written in the next driving period, and enabling the data signal of each sub-pixel to be accurately written to the gate of the driving transistor of the each sub-pixel. In this way, in the light emitting stage, when the driving transistor provides the driving current to the organic light emitting element, the luminous brightness level of the organic light emitting element can be accurately controlled, and improving the display effect of the display panel.

Before the data signal is written to the gate of the driving transistor of each sub-pixel, an initialization signal is simultaneously provided to the gate of the driving transistor of each sub-pixel of each sub-display region to initialize the gate of the driving transistor. In one embodiment, each pixel driving circuit may further include an initialization transistor, and each initialization transistor may be controlled to be turned on or off through corresponding a scanning signal. When the initialization transistor is turned on, an initialization signal is written to the gate of the driving transistor, and at this time, the gate of the driving transistor of each sub-pixel may be initialized according to the sub-pixels in a row or a column.

Figure 10:
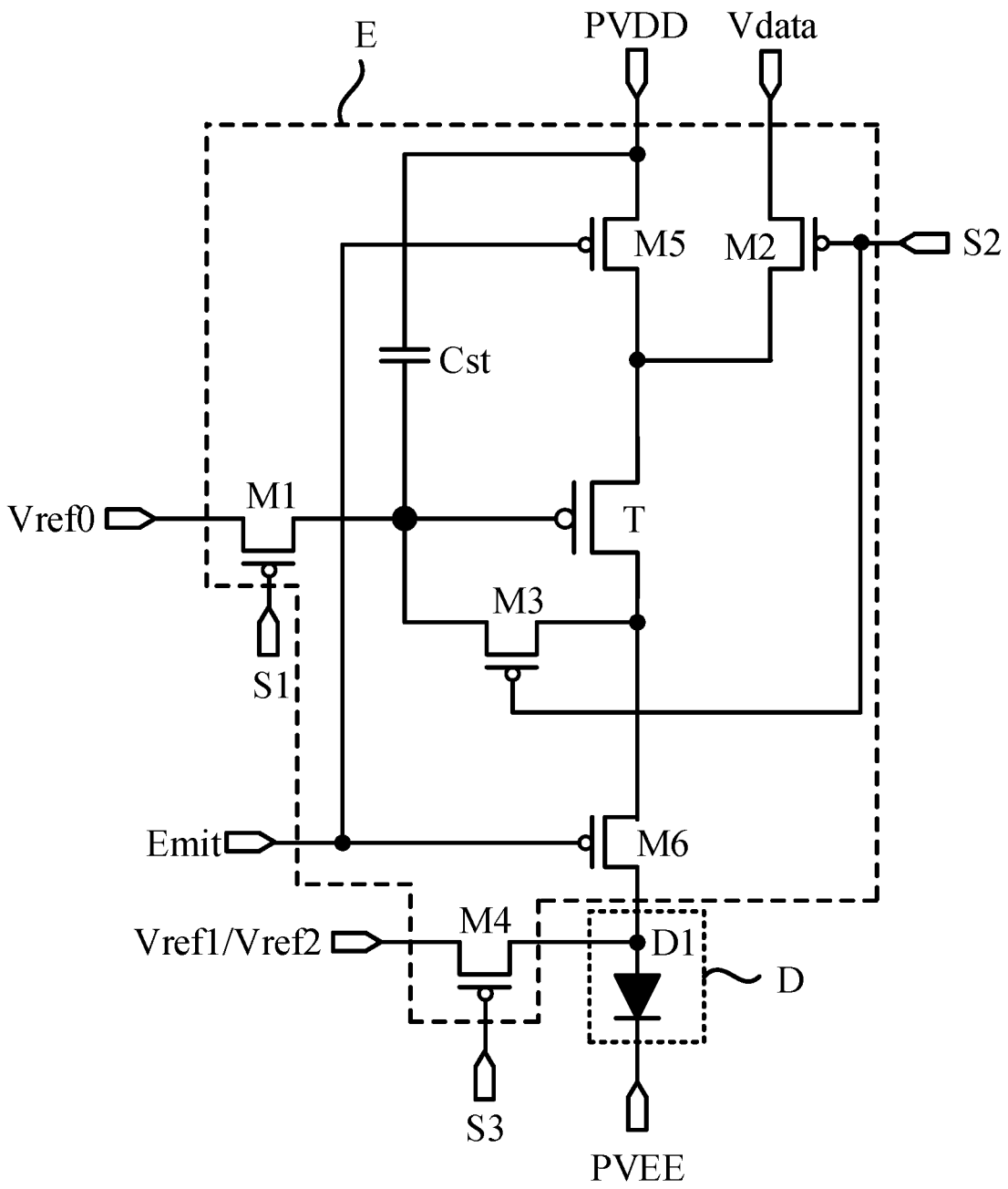
FIG. 10 is a structure view of another sub-pixel according to an embodiment of the present disclosure.
Figure 11:
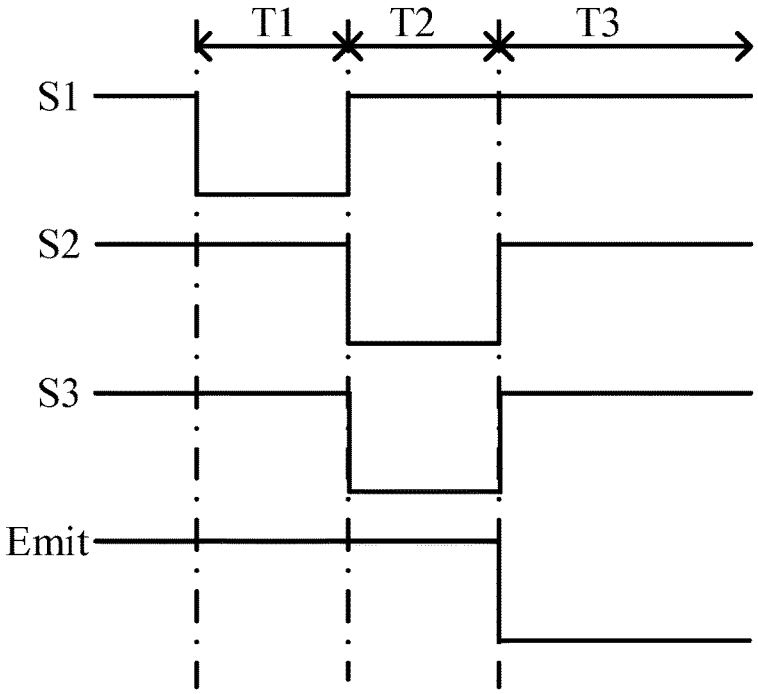
FIG. 11 is a driving timing schematic diagram of a sub-pixel corresponding to FIG. 10.

In an embodiment, FIG. 10 is a structure view of another sub-pixel according to an embodiment of the present disclosure; and FIG. 11 is a schematic diagram of driving timing of a sub-pixel corresponding to FIG. 10. The reset stage and the data writing stage being a same stage is described as an example. In conjunction with FIG. 10 and FIG. 11, the sub-pixel includes a pixel driving circuit E and an organic light emitting element D. The pixel driving circuit E includes a driving transistor T, an initialization transistor M1, a data writing transistor M2, a threshold compensation transistor M3, a reset transistor M4, light emitting control transistors M5 and M6, and a storage capacitor Cst. At this time, in the initialization stage T1 of the sub-pixel, an enable level of a scanning signal S1 is provided to the initialization transistor M1 of the sub-pixel so that the initialization transistor M1 is turned on, and an initialization signal Vref0 is written into the gate of the driving transistor T and the storage capacitor Cst through the turned-on initialization transistor M1 to initialize the gate of the driving transistor T and the storage capacitor Cst. In the data writing stage T2 of the sub-pixel, an enable level of a scanning signal S2 is provided to the data writing transistor M2 and the threshold compensation transistor M3 of the sub-pixel, the data writing transistor M2 and the threshold compensation transistor M3 are turned on, a data signal Vdata is written into the gate of the driving transistor T and the storage capacitor Cst through the data writing transistor M2, the driving transistor T, and the threshold compensation transistor M3 in sequence, so that a signal in the gate of the driving transistor T and the storage capacitor Cst includes a threshold voltage of the driving transistor T and the data signal Vdata corresponding to the gray scale value of the sub-pixel. At the same time of writing data, the anode D1 of the organic light emitting element D is reset. That is to say, in the reset stage T2, an enable level of a scanning signal S3 is provided to the reset transistor M4 of the sub-pixel, the reset transistor M4 is turned on. The first reset signal Vref1 or the second reset signal Vref2 is written to the anode D1 of the organic light emitting element D through the turned-on reset transistor M4 to reset the anode D1 of the organic light emitting element D. In the light emitting stage T3 of the sub-pixel, an enable level of a light emitting control signal Emit is provided to the light emitting control transistors M5 and M6 of the sub-pixel, a path is formed between a positive power supply voltage signal PVDD and a negative power supply voltage signal PVEE, and a driving current generated by the driving transistor T according to the gate potential of the driving transistor T flows into the organic light emitting element D, the organic light emitting element D emits light according to the driving current.

In this way, when transistors in pixel driving circuits of sub-pixels in the same row share the scanning signal and the light emitting control signal, the driving transistors of each row of sub-pixels are initialized sequentially. In addition, after the initialization stage of a corresponding row of sub-pixels, the data signal is written to the driving transistors of the row of sub-pixels and the first reset signal Vref1 or the second reset signal Vref2 is provided to anodes of the organic light emitting elements of the row of sub-pixels as required, and after the data writing stage and the reset stage of the row of sub-pixels are finished, the organic light emitting elements of the row of sub-pixels are controlled to emit light.

Figure 12:
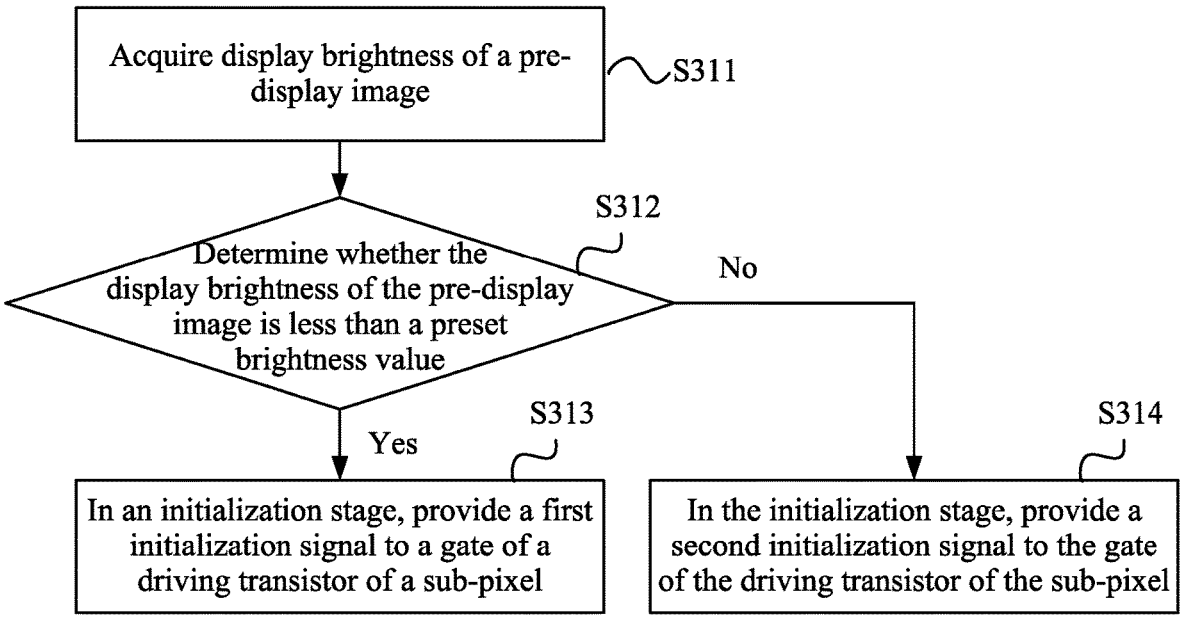
FIG. 12 is a flowchart of a method for providing an initialization signal according to an embodiment of the present disclosure.

In an embodiment, FIG. 12 is a flowchart of a method for providing an initialization signal according to an embodiment of the present disclosure. As shown in FIG. 12, the method for providing the initialization signal includes steps described below.

In S311, display brightness of a pre-display image is acquired.

In S312, whether the display brightness of the pre-display image is less than a preset brightness value is determined; if yes, S313 is executed; and if no, S314 is executed.

In S313, a first initialization signal is provided to a gate of a driving transistor of a sub-pixel in an initialization stage.

In S314, a second initialization signal is provided to the gate of the driving transistor of the sub-pixel in the initialization stage.

When the driving transistor is a P-type transistor, a voltage of the first initialization signal is greater than a voltage of the second initialization signal; or when the driving transistor is an N-type transistor, the voltage of the first initialization signal is less than the voltage of the second initialization signal.

In an embodiment, the pixel driving circuit shown in FIG. 10 is described as an example. Generally, when the display panel displays, the display brightness of the display panel may be adjusted according to the environment or user requirements. In the light emitting holding stage of the organic light emitting element D in the display panel, the purpose of controlling the display brightness of the display panel is achieved by controlling a duty ratio of the enable level of the light emitting control signal provided to the light emitting control transistors M5 and M6 of each sub-pixel. The higher the duty ratio of the enable level of the light emitting control signal, the higher the integral value of brightness with respect to time, the brightness of the image displayed on the display panel is higher. The lower the duty ratio of the enable level in the light emitting control signal, the lower the integral value of brightness with respect to time, the brightness of the image displayed on the display panel is lower. At the same time, since the organic light emitting element D may be equivalent to a capacitor and a diode, when the driving transistor T provides a driving current to the organic light emitting element, the equivalent capacitor of the organic light emitting element D needs to be charged until the equivalent capacitor of the organic light emitting element D reaches a value, the organic light emitting element D can emit light stably. Since organic light emitting elements of different colors have different equivalent capacitors, the organic light emitting elements D of different colors have different charging time. For example, the organic light emitting element having a red light emitting color and the organic light emitting element having a blue light emitting color require shorter charging time, and the organic light emitting element having a green light emitting color require longer charging time, the red organic light emitting element and the blue organic light emitting element have longer stable light emitting time than the green organic light emitting element in a light emitting period, the color of the display image displayed by the display panel appear more a mixed color of red and blue, that is, the display panel has a degree of color cast. Moreover, compared with a condition that the display panel displays a display image having higher brightness, when the display panel displays a display image having lower brightness, the duty ratio of the enable level of the light emitting control signal provided to the light emitting control transistors M5 and M6 of each sub-pixel is low, that is, total light emitting time of the organic light emitting element D of each sub-pixel is short, so that the phenomenon of color cast caused by the different duration of stable light emitting of the organic light emitting elements of different light emitting colors is more apparent.

When the display brightness of the pre-display image is less than the preset brightness value, the pre-display image may be considered as a low brightness display image. When the display brightness of the pre-display image is greater than or equal to the preset brightness value, the pre-display image may be considered as a non-low brightness display image.

In the initialization stage, an initialization signal with a negative voltage value is typically written to the gate of the driving transistor to ensure that data signals corresponding to different gray scale values can all be written to the gate of the driving transistor after the initialization stage. However, voltage values of data signals corresponding to different gray scale values are typically positive values. At this time, if the pre-display image of the display panel is a low brightness display image, a first initialization signal having a larger voltage may be provided in the initialization stage the voltage of the first initialization signal is positively biased. In this way, the voltage of the first initialization signal is closer to the voltage of the data signal, and the data signal written to the gate of the driving transistor can be ensured to be more sufficient and accurate. In this way, in the light emitting stage, the driving transistor can provide more sufficient driving current to the organic light emitting element according to the potential the gate of the driving transistor, and when the organic light emitting element is charged by the driving current, the time required for the organic light emitting elements to emit light stably from being charged can be shortened, and the time for each organic light emitting element to emit light stably can be correspondingly increased, and improving the phenomenon of color cast of the low brightness display image.

Figure 13:
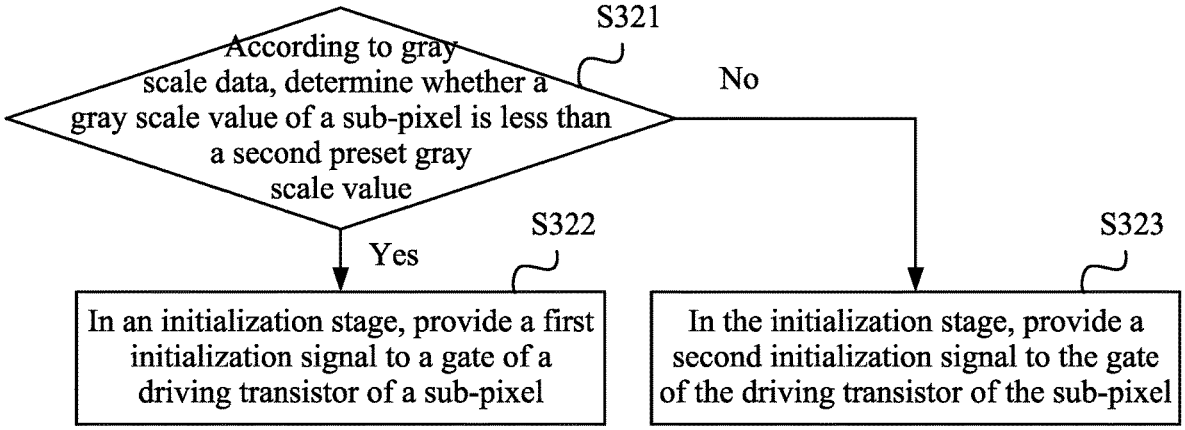
FIG. 13 is a flowchart of another method for providing an initialization signal according to an embodiment of the present disclosure.

In an embodiment, FIG. 13 is a flowchart of another method for providing an initialization signal according to an embodiment of the present disclosure. As shown in FIG. 13, the method for providing the initialization signal includes steps described below.

In S321, whether a gray scale value of a sub-pixel is less than a second preset gray scale value is determined according to gray scale data; if yes, S322 is executed; and if no, S323 is executed.

In S322, a first initialization signal is provided to a gate of a driving transistor of the sub-pixel in an initialization stage.

In S323, a second initialization signal is provided to the gate of the driving transistor of the sub-pixel in the initialization stage.

When the driving transistor is a P-type transistor, a voltage of the first initialization signal is greater than a voltage of the second initialization signal; or when the driving transistor is an N-type transistor, the voltage of the first initialization signal is less than the voltage of the second initialization signal. When the gray scale value of the sub-pixel is less than the second preset gray scale value, the gray scale value of the sub-pixel may be considered within a low gray scale value. When the gray scale value of the sub-pixel is greater than or equal to the second preset gray scale value, the gray scale value of the sub-pixel may be considered within a non-low gray scale value. In an embodiment, the second preset gray scale value may be equal to the first preset gray scale value, and the voltage of the first initialization signal may be equal to the voltage of the second initialization signal. For example, the second preset gray scale value is 30, and the voltage of the first initialization signal is −5V.

In an embodiment, for the P-type driving transistor, the higher the potential of the gate of the P-type driving transistor, the less the driving current generated by the P-type driving transistor, that is, the less the gray scale value of the sub-pixel, the larger the voltage of the data signal corresponding to the sub-pixel. On the contrary, the larger the gray scale value of the sub-pixel, the less the voltage of the data signal corresponding to the sub-pixel. Therefore, when the gray scale value of the sub-pixel is relatively lower, the voltage of the data signal corresponding to the gray scale value is relatively higher. In the initialization stage, the first initialization signal having a larger voltage is provided to the gate of the driving transistor of the sub-pixel, the data signal corresponding to the gray scale value can be quickly and accurately written to the gate of the driving transistor in the data writing stage. On the contrary, when the gray scale value of the sub-pixel is relatively higher, the voltage of the data signal corresponding to the gray scale value is relatively lower. In the initialization stage, the first initialization signal having a less voltage is provided to the gate of the driving transistor of the sub-pixel, the data signal corresponding to the gray scale value can be quickly and accurately written to the gate of the driving transistor in the data writing stage.

Correspondingly, for the N-type driving transistor, the lower the potential of the gate of the N-type driving transistor, the less the driving current generated by the N-type driving transistor, that is, the less the gray scale value of the sub-pixel, the less the voltage of the data signal corresponding to the sub-pixel. On the contrary, the larger the gray scale value of the sub-pixel, the greater the voltage of the data signal corresponding to the sub-pixel. Therefore, when the gray scale value of the sub-pixel is relatively lower, the voltage of the data signal corresponding to the gray scale value is relatively lower. In the initialization stage, the first initialization signal having a less voltage is provided to the gate of the driving transistor of the sub-pixel, the data signal corresponding to the gray scale value can be quickly and accurately written to the gate of the driving transistor in the data writing stage. On the contrary, when the gray scale value of the sub-pixel is relatively higher, the voltage of the data signal corresponding to the gray scale value is relatively higher. In the initialization stage, the first initialization signal having a larger voltage is provided to the gate of the driving transistor of the sub-pixel, the data signal corresponding to the gray scale value can be quickly and accurately written to the gate of the driving transistor in the data writing stage.

It is to be noted that the above implementation mode of providing the corresponding initialization signal according to the gray scale value of the sub-pixel may be described below. In a frame of display image, if more sub-pixels where a gray scale value of the sub-pixel is less than the second preset gray scale value (for example, the number percentage is greater than or equal to 50%) are included, gray scale values of all the sub-pixels of the frame of display image are considered to be less than the second preset gray scale value, to provide the first initialization signal to the gate of the driving transistor of each sub-pixel. However, in a frame of display image, if more sub-pixels where a gray scale value of the sub-pixel is greater than or equal to the second preset gray scale value (for example, the number percentage is greater than or equal to 50%) are included, gray scale values of all the sub-pixels of the frame of display image are considered to be greater than or equal to the second preset gray scale value, to provide the second initialization signal to the gate of the driving transistor of each sub-pixel. In one embodiment, an implementation mode of providing the corresponding initialization signal according to the gray scale value of the sub-pixel may further be described below. Each sub-pixel is individually provided with a corresponding first initialization signal or a second initialization signal according to the gray scale value of the each sub-pixel. At this time, the pixel driving circuit of each sub-pixel should include an initialization transistor to be able to address each sub-pixel one by one and write initialization signals to the initialization transistors one by one.

Based on the same inventive concept, embodiments of the present disclosure further provide a driving device of a display panel. The driving device of the display panel may be integrated into a driving chip, and the driving device of the display panel can execute the driving method of the display panel provided by the embodiments of the present disclosure and drive the display panel provided by the embodiment of the present disclosure. Therefore, the driving device of the display panel provided by the embodiments of the present disclosure has the characteristics of the driving method of the display panel provided by the embodiments of the present disclosure and can achieve the beneficial effects of the driving method of the display panel provided by the embodiments of the present disclosure. Similarities may be referred to the above description of the driving method of the display panel provided by the embodiments of the present disclosure and will not be repeated herein.

A display panel driven by the driving device of the display panel includes a display region. The display region includes at least one sub-display region, and each sub-display region includes at least one pixel unit. Each pixel unit includes a plurality of sub-pixels having different light emitting colors. Each sub-pixel includes an organic light emitting element. Each pixel unit includes at least one first sub-pixel and at least one second sub-pixel. The at least one second sub-pixel includes a sub-pixel having at least one light emitting color different from a light emitting color of the at least one first sub-pixel. A working voltage of the first sub-pixel is less than a working voltage of the second sub-pixel.

Figure 14:
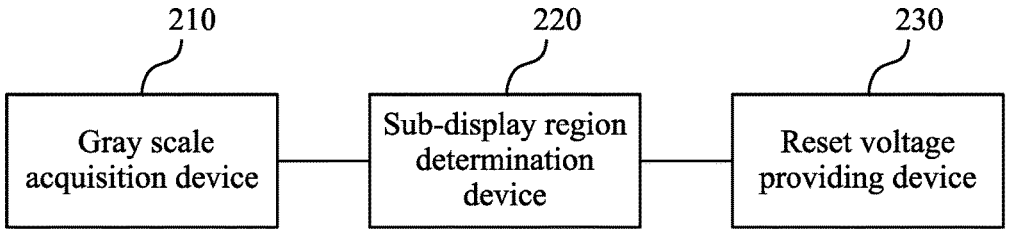
FIG. 14 is a block diagram of a driving device of a display panel according to an embodiment of the present disclosure.

In an embodiment, FIG. 14 is a block diagram of a driving device of a display panel according to an embodiment of the present disclosure. As shown in FIG. 14, the driving device of the display panel includes a gray scale acquisition device 210, a sub-display region determination device 220, and a reset voltage providing device 230. The gray scale acquisition device 210 is configured to acquire gray scale data of a frame of display image. The gray scale data includes gray scale values in one-to-one correspondence with sub-pixels. The sub-display region determination device 220 is configured to, according to the gray scale data, determine a sub-display region in which a gray scale value of each first sub-pixel is 0 and a gray scale value of each second sub-pixel is less than a first preset gray scale value as a first sub-display region; and determine a sub-display region in which not all of the gray scale values of the first sub-pixels are 0 and not all of the gray scale values of the second sub-pixels are less than the first preset gray scale value as a second sub-display region. The reset voltage providing device 230 is configured to, in a reset stage, provide a first reset signal to anodes of organic light emitting elements of sub-pixels of the first sub-display region and a second reset signal to anodes of organic light emitting elements of sub-pixels of the second sub-display region. A voltage of the first reset signal is less than a voltage of the second reset signal.

Based on the same inventive concept, embodiments of the present disclosure further provide a display device. The display device includes the display panel provided by the embodiments of the present disclosure and a driver chip, and the driver chip is configured to execute the driving method of the display panel provided by the embodiments of the present disclosure. Therefore, the display device provided by the embodiments of the present disclosure has the characteristics of the driving method of the display panel and the display panel provided by the embodiments of the present disclosure and can achieve the beneficial effects of the driving method of the display panel and the display panel provided by the embodiments of the present disclosure. Similarities may be referred to the above description of the driving method of the display panel provided by the embodiments of the present disclosure and will not be repeated herein.

Figure 15:
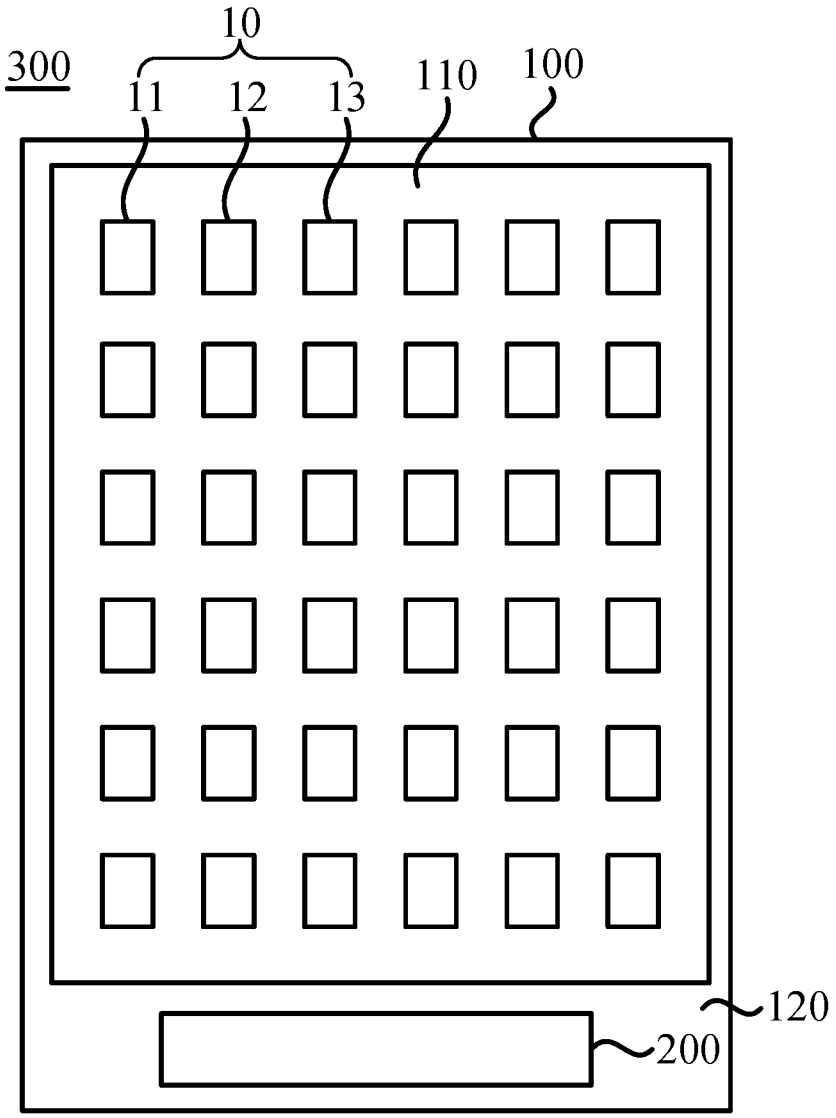
FIG. 15 is a structure view of a display device according to an embodiment of the present disclosure.

In an embodiment, FIG. 15 is a structure view of a display device according to an embodiment of the present disclosure. As shown in FIG. 15, the display device 300 includes a display panel 100 and a driver chip 200. The display panel 100 includes a display region 110 and a non-display region 120, and the driver chip 200 is disposed in the non-display region 120 of the display panel 100. The display region 110 includes at least one sub-display region, and each sub-display region includes at least one pixel unit 10. Each pixel unit 10 includes a plurality of sub-pixels having different light emitting colors. Each sub-pixel includes an organic light emitting element. Each pixel unit 10 includes at least one first sub-pixel 11 and at least one second sub-pixel 12 or 13. The at least one second sub-pixel 12 or 13 includes a sub-pixel having at least one light emitting color different from a light emitting color of the at least one first sub-pixel 11. A working voltage of the first sub-pixel 11 is less than a working voltage of the second sub-pixel 12 or 13. The display device 300 may include, but is not limited to, a mobile phone, a computer, a tablet, a wearable display device, and the like.

In an embodiment, when the sub-pixel includes a pixel driving circuit and the pixel driving circuit at least includes a reset transistor, a second pole of the reset transistor may be electrically connected to an anode of the organic light emitting element. At this time, the display panel further includes a scanning driving circuit, at least one reset signal bus, a plurality of reset signal lines, and a plurality of first scanning signal lines. First output ends of the scanning driving circuit are electrically connected to first scan signal lines. Gates of reset transistors of sub-pixels in a same row are electrically connected to a same first scanning signal line. First poles of reset transistors of sub-pixels in a same row and belonging to a same sub-display region are electrically connected to a same reset signal line. The reset signal lines which are respectively electrically connected to reset transistors in a same sub-display region are electrically connected to a same reset signal bus. The driver chip includes a plurality of reset signal output ends 60 and at least one scanning control end 70. The scanning control end 70 is electrically connected to a control end of the scanning driving circuit. The reset signal output ends 60 are electrically connected to a plurality of reset signal buses in one-to-one correspondence. The driver chip is further configured to control the scanning driving circuit to sequentially output the first scanning signal to the respective first scanning signal line to control reset transistors of a plurality of rows of sub-pixels to turn on, and to provide reset signals to reset signal buses in one-to-one correspondence, the reset signals are written to the anodes of the organic light emitting elements through the turned-on reset transistors. The reset signals include a first reset signal and/or a second reset signal.

Figure 16:
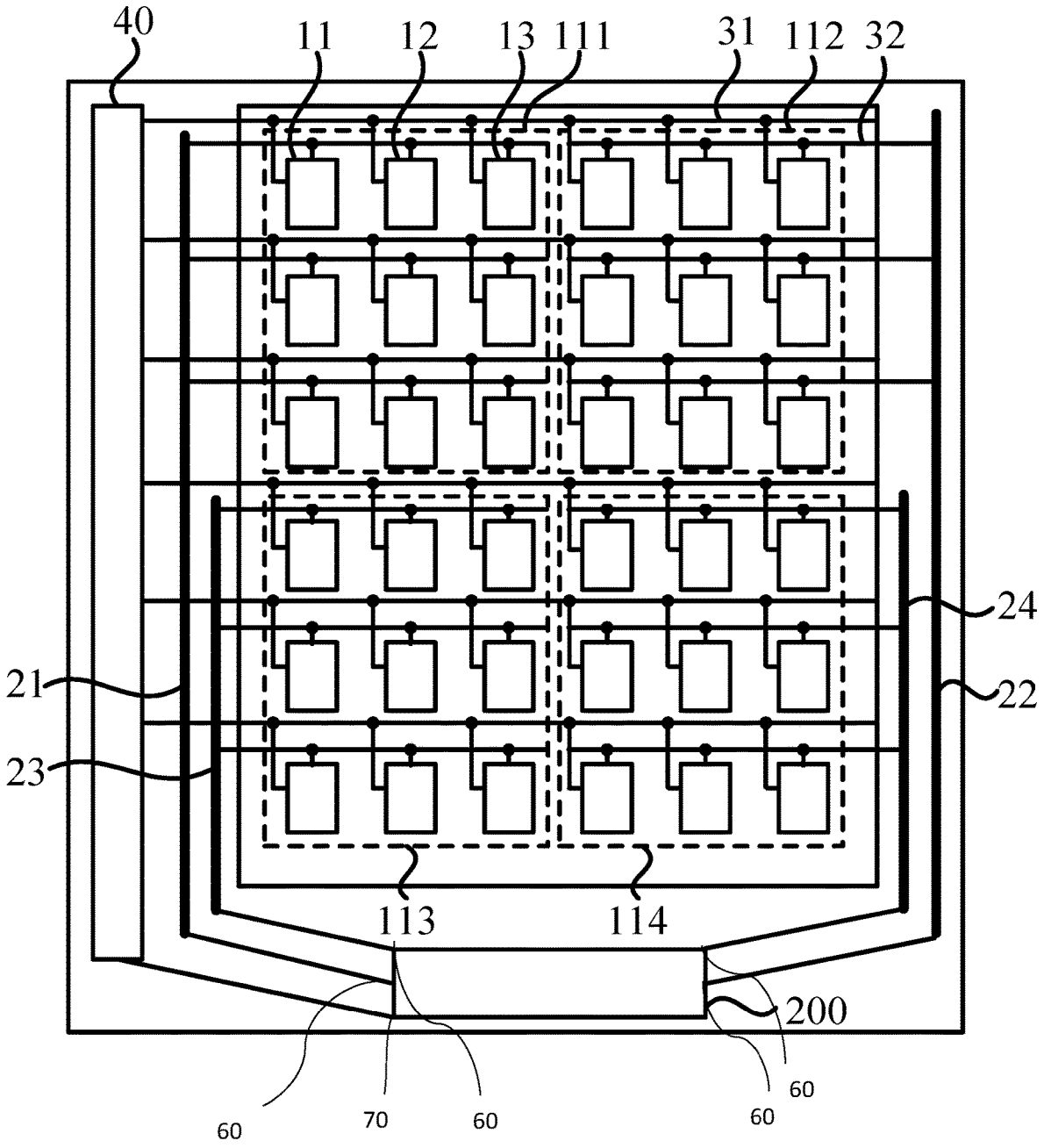
FIG. 16 is a structure view of another display device according to an embodiment of the present disclosure.
Figure 17:
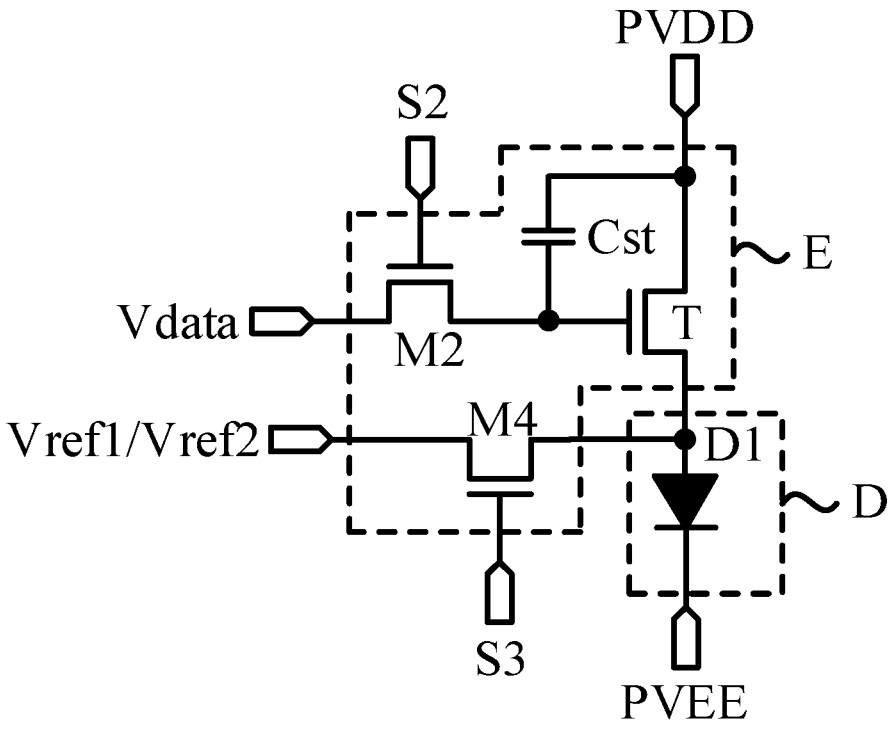
FIG. 17 is a structure view of another sub-pixel according to an embodiment of the present disclosure.

In an embodiment, FIG. 16 is a structure view of a display device according to an embodiment of the present disclosure; and FIG. 17 is a structure view of another sub-pixel according to an embodiment of the present disclosure. In conjunction with FIG. 16 and FIG. 17, the display region 110 of the display panel 100 including four sub-regions 111, 112, 113 and 114 is described as an example. The display panel 100 may be provided with four reset signal buses 21, 22, 23 and 24 in one-to-one correspondence with the four sub-display regions 111, 112, 113 and 114. A reset signal line 32 electrically connected to the sub-pixels 11, 12, and 13 in the sub-display region 111 is electrically connected to a reset signal bus 21, the sub-pixels 11, 12, and 13 in the sub-display region 111 can receive the reset signal provided by the driver chip 200 through the reset signal bus 21 and the reset signal line 32 sequentially. A reset signal line 32 electrically connected to the sub-pixels 11, 12, and 13 in the sub-display region 112 is electrically connected to a reset signal bus 22, the sub-pixels 11, 12, and 13 in the sub-display region 112 can receive the reset signal provided by the driver chip 200 through the reset signal bus 22 and the reset signal line 32 sequentially. A reset signal line 32 electrically connected to the sub-pixels 11, 12, and 13 in the sub-display region 113 is electrically connected to a reset signal bus 23, the sub-pixels 11, 12, and 13 in the sub-display region 113 can receive the reset signal provided by the driver chip 200 through the reset signal bus 23 and the reset signal line 32 sequentially. A reset signal line 32 electrically connected to the sub-pixels 11, 12, and 13 in the sub-display region 114 is electrically connected to a reset signal bus 24, the sub-pixels 11, 12, and 13 in the sub-display region 114 can receive the reset signal provided by the driver chip 200 through the reset signal bus 24 and the reset signal line 32 sequentially.

Correspondingly, the sub-pixel includes a pixel driving circuit E and an organic light emitting element D. The pixel driving circuit E may include a driving transistor T, a data writing transistor M2, a reset transistor M4 and a storage capacitor Cst. The driver chip 200 can control the scanning driving circuit 40 to sequentially output the first scanning signal S3 to the respective first scanning signal line 31 to control the reset transistors M4 of rows of sub-pixels to be turned on. In this way, reset signals transmitted by reset signal buses 21, 22, 23, and 24 can be written to anodes D1 of organic light emitting elements D through the reset signal lines 32 and the turned-on reset transistors M4 to sequentially reset the anodes D1 of the organic light emitting elements D of rows of sub-pixels.

Correspondingly, the scanning driving circuit 40 may further provide corresponding scanning signals S2 to data writing transistors M2 of rows of sub-pixels, data signals Vdata can be written to gates of driving transistors T of rows of sub-pixels through the turned-on data writing transistors M2.

Figure 18:
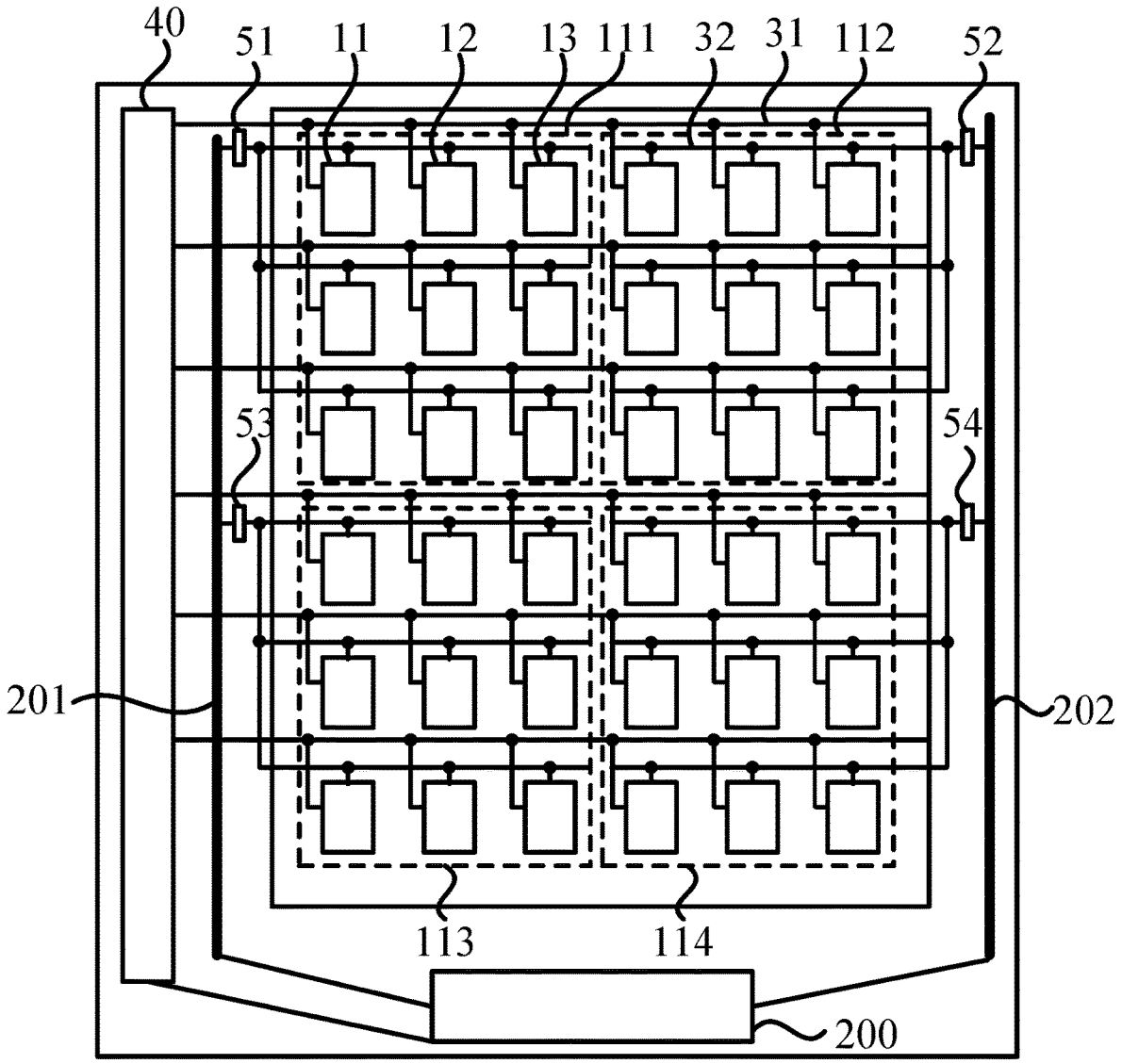
FIG. 18 is a structure view of another display device according to an embodiment of the present disclosure.

In an embodiment, FIG. 18 is a structure view of another display device according to an embodiment of the present disclosure. As shown in FIG. 18, the display panel 100 of the display device 300 includes a plurality of sub-display regions, for example, the display panel 100 includes four sub-display regions 111, 112, 113 and 114. The display panel 100 further includes a plurality of first switch devices 51, 52, 53, and 54 arranged in one-to-one correspondence with sub-display regions 111, 112, 113 and 114. The reset signal bus 201 is electrically connected to a plurality of reset signal lines 32 of a same sub-display region 111 or 113 through a first switch device 51 or 53. The reset signal bus 202 is electrically connected to a plurality of reset signal lines 32 of a same sub-display region 112 or 114 through a first switch device 52 or 54. In sub-display regions 111 and 113 or sub-display regions 112 and 114 in a same column, reset transistors are electrically connected to a same reset signal bus 201 or 202 through reset signal lines 32 and the first switch device 51 and 52 or the first switch device 53 and 54 sequentially. For example, the sub-display region 111 is in the same column as the sub-display region 113, the sub-display region 111 and the sub-display region 113 share a same reset signal bus 201, and the sub-display region 112 is in the same column as the sub-display region 114, the sub-display region 112 and the sub-display region 114 share a same reset signal bus 202. In this way, the reset signal bus 201 is electrically connected to a plurality of reset signal lines 32 of the sub-display region 111 through the first switch device 51, the reset signal bus 202 is electrically connected to a plurality of reset signal lines 32 of the sub-display region 112 through the first switch device 52, the reset signal bus 201 is electrically connected to a plurality of reset signal lines 32 of the sub-display region 113 through the first switch device 53, and the reset signal bus 202 is electrically connected to a plurality of reset signal lines 32 of the sub-display region 114 through the first switch device 54. The first switch device can be controlled to be turned on in the reset stage of sub-pixels of sub-display regions corresponding to the first switch device, a plurality of reset signals are written to the sub-display regions in one-to-one correspondence. In this way, on the premise of providing reset signals to sub-display regions as required is satisfied, it is beneficial to reducing terminals for providing the reset signals in the driver chip, and simplifying the structure of the driver chip, reducing the cost of the driver chip, and further facilitating the reduction of the cost of the display device.

Figure 19:
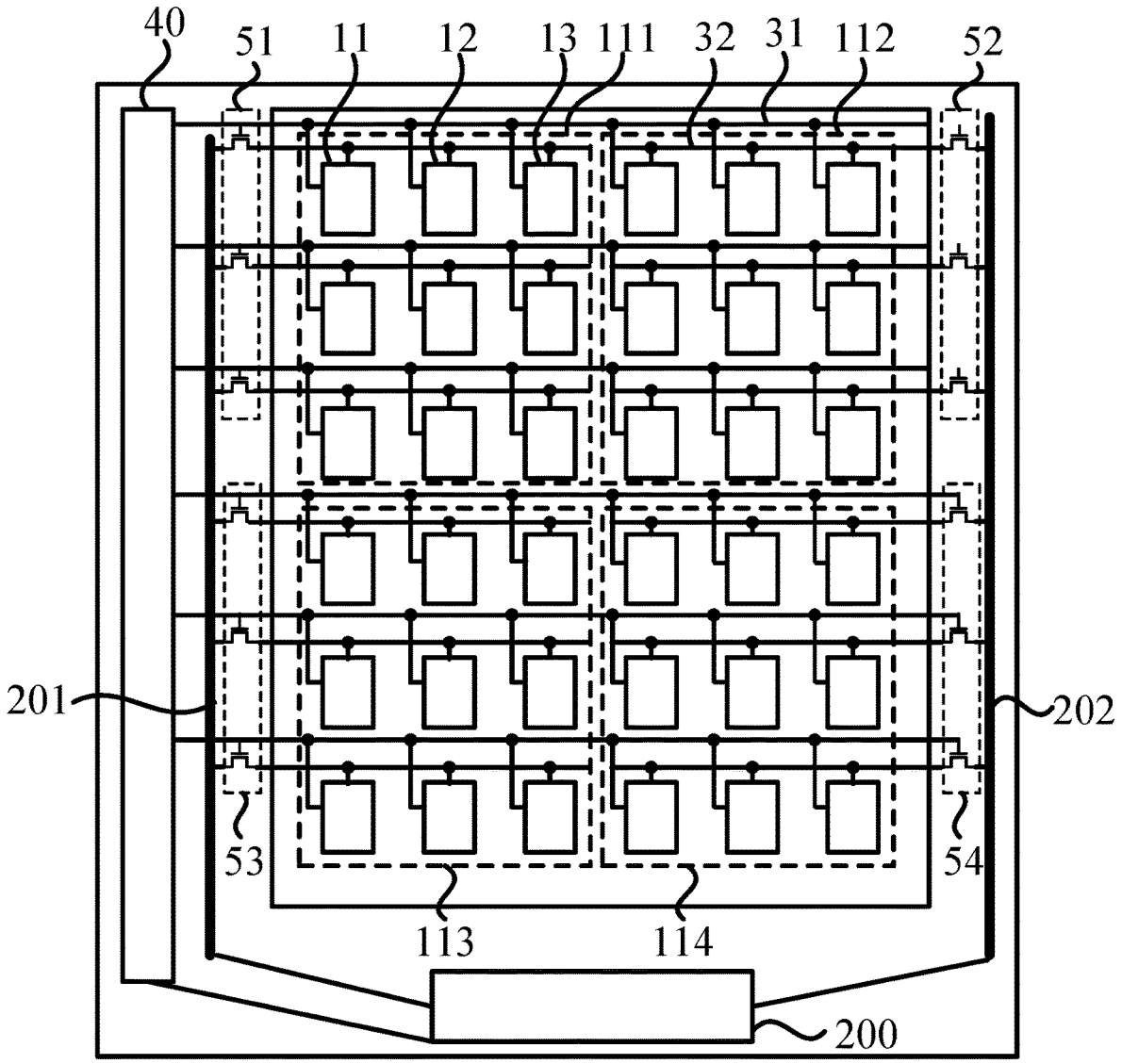
FIG. 19 is a structure view of another display device according to an embodiment of the present disclosure.

In an embodiment, FIG. 19 is a structure view of another display device according to an embodiment of the present disclosure. As shown in FIG. 19, each first switch device 51, 52, 53 or 54 includes at least one switch transistor. A first pole of each switch transistor is electrically connected to a reset signal bus 201 or 202, and a second pole of each switch transistor is electrically connected to one reset signal line 32. A gate of the switch transistor is electrically connected to one first scanning signal line 31. The switch transistor is configured to be turned on or off under the control of the first scanning signal transmitted by the first scanning signal line 31.

In this way, each switch transistor in the first switch device is electrically connected to a first scanning signal line electrically connected to a gate of a reset transistor in a sub-pixel, and the sub-pixel is electrically connected to a reset signal line corresponding to the switch transistor, in the reset stage of each row of sub-pixels, the first scanning signal transmitted by the first scanning signal line can simultaneously control the reset transistors of the row of sub-pixels to be electrically connected to the switch transistor corresponding to the row of sub-pixels. Therefore, the number of control signals provided to the display panel can be reduced, facilitating reduction of number of terminals in the driver chip, reducing the cost of the driver chip, and reducing the cost of the display device.

In an embodiment, each sub-pixel further includes a pixel driving circuit, and the pixel driving circuit includes at least a driving transistor and an initialization transistor. A second pole of the initialization transistor is electrically connected to a gate of the driving transistor. The display panel further includes a scanning driving circuit, a plurality of initialization signal lines and a plurality of second scanning signal lines. Second output ends of the scanning driving circuit are electrically connected to second scanning signal lines. Gates of the initialization transistors of sub-pixels in the same row are electrically connected to the same second scanning signal line. First poles of the initialization transistors of sub-pixels in the same column are electrically connected to the same initialization signal line. The driver chip includes a plurality of initialization signal output ends and at least one scanning control end. The scanning control end is electrically connected to a control end of the scanning driving circuit. Initialization signal output ends are electrically connected to initialization signal lines in one-to-one correspondence. The driver chip is further configured to control the scanning driving circuit to sequentially output the second scanning signals to second scanning signal lines to control the initialization transistors of each row of sub-pixels to be turned on, and to provide initialization signals to initialization signal lines in one-to-one correspondence, the initialization signals are written to the gates of the driving transistors through the turned-on initialization transistors. The initialization signals include a first initialization signal and/or a second initialization signal.

Figure 20:
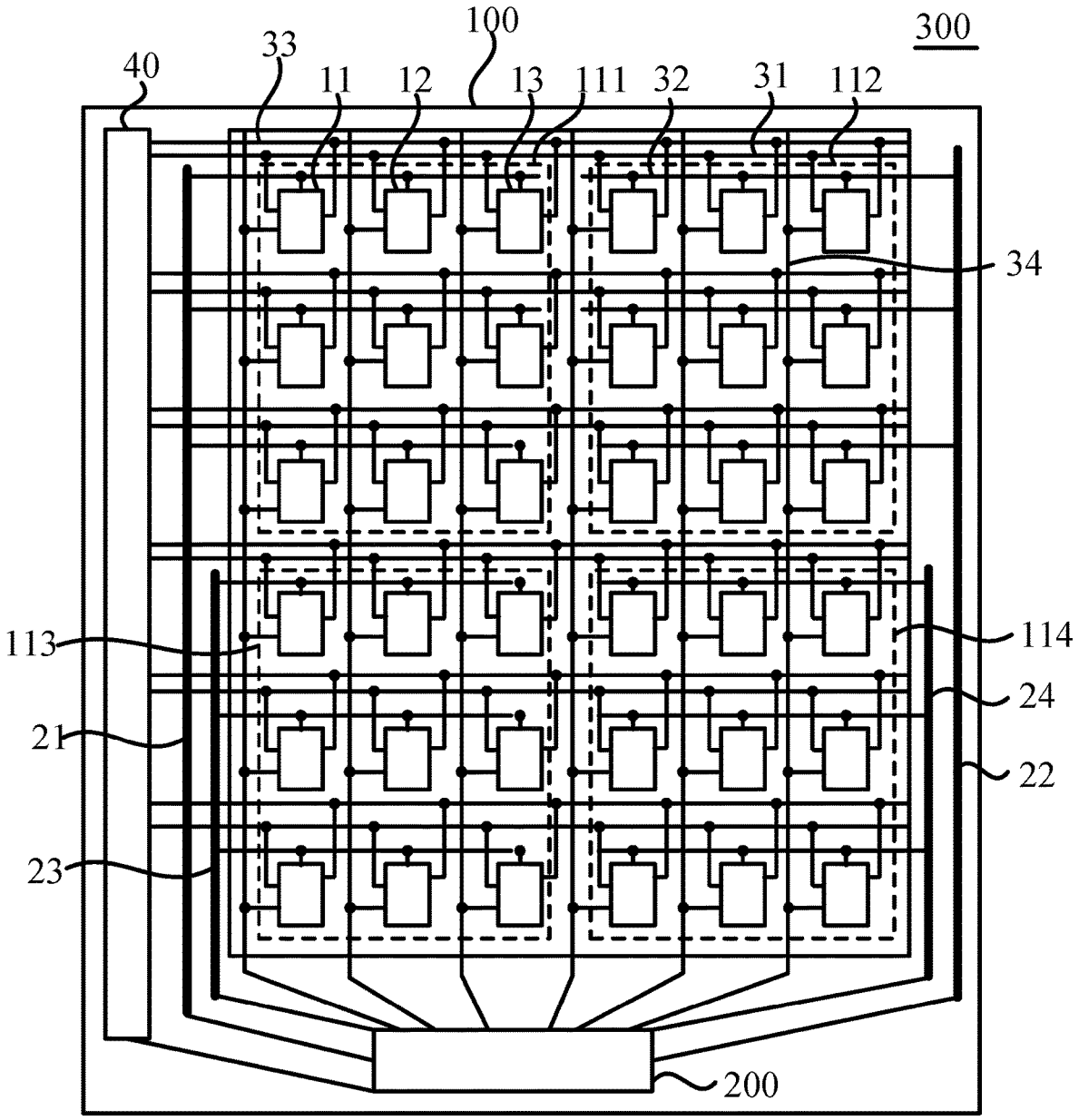
FIG. 20 is a structure view of another display device according to an embodiment of the present disclosure.

In an embodiment, the sub-pixel shown in FIG. 10 is described as an example. FIG. 20 is a structure view of another display device according to an embodiment of the present disclosure. In conjunction with FIG. 10 and FIG. 20, when the gates of initialization transistors M1 of sub-pixels in the same row are electrically connected to the same second scanning signal line 33, and first poles of initialization transistors M1 of sub-pixels in the same column are electrically connected to the same initialization signal line 34, the driver chip 200 can control the scanning driving circuit 40 to sequentially provide second scan signals S1 to the second scanning signal lines 33, when the initialization transistors M1 of one row of sub-pixels are controlled to be turned on by the second scanning signal S1 transmitted by the second scanning signal line 33, the initialization signals Vref0 transmitted by the initialization signal lines 34 can be written to the gates of the driving transistors T of sub-pixels in one-to-one correspondence through the turned-on initialization transistors M1. In this way, a corresponding initialization signal Vref0 can be provided to the gate of the driving transistor of each sub-pixel as required.

What is claimed is:

1. A driving method of a display panel, wherein the display panel comprises a display region, the display region comprises at least one sub-display region, and each of the at least one sub-display region comprises at least one pixel unit; each of the at least one pixel unit comprises a plurality of sub-pixels having different light emitting colors; each of the plurality of sub-pixels comprises an organic light emitting element; the plurality of sub-pixels of the each of the at least one pixel unit comprises at least one first sub-pixel and at least one second sub-pixel; the at least one second sub-pixel comprises a sub-pixel having at least one light emitting color different from a light emitting color of the at least one first sub-pixel; and a working voltage of the at least one first sub-pixel is less than a working voltage of the at least one second sub-pixel; and the driving method of the display panel comprises:

acquiring gray scale data of a pre-display image, wherein the gray scale data comprises gray scale values in one-to-one correspondence with the plurality of sub-pixels;

according to the gray scale data, determining a sub-display region in which all gray scale values of first sub-pixels are 0 and all gray scale values of second sub-pixels are less than a first preset gray scale value as a first sub-display region, and determining a sub-display region in which not all of the gray scale values of the first sub-pixels are 0 and not all of the gray scale values of the second sub-pixels are less than the first preset gray scale value as a second sub-display region; and in a reset stage, providing a first reset signal to an anode of an organic light emitting element of a sub-pixel of the first sub-display region and a second reset signal to an anode of an organic light emitting element of a sub-pixel of the second sub-display region; wherein a voltage of the first reset signal is less than a voltage of the second reset signal.

2. The driving method of the display panel of claim 1, wherein the each of the plurality of sub-pixels further comprises a pixel driving circuit, and the pixel driving circuit at least comprises a driving transistor; wherein the driving method of the display panel further comprises:

in a data writing stage, providing a data signal corresponding to a gray scale value of a sub-pixel to a gate of a driving transistor of the sub-pixel; and in a light emitting stage, controlling the driving transistor of the sub-pixel to provide, according to the data signal, a driving current to the organic light emitting element to cause the organic light emitting element to emit light; wherein the reset stage of the sub-pixel is before the light emitting stage of the sub-pixel.

3. The driving method of the display panel of claim 2, further comprising:

in an initialization stage, providing an initialization signal to the gate of the driving transistor of the sub-pixel; wherein the initialization stage of the sub-pixel is before the data writing stage of the sub-pixel.

4. The driving method of the display panel of claim 3, wherein in the initialization stage, providing the initialization signal to the gate of the driving transistor of the sub-pixel comprises:

according to the gray scale data, determining whether the gray scale value of the sub-pixel is less than a second preset gray scale value;

if yes, providing a first initialization signal to the gate of the driving transistor of the sub-pixel in the initialization stage; and if no, providing a second initialization signal to the gate of the driving transistor of the sub-pixel in the initialization stage; wherein in responding to the driving transistor being a P-type transistor, a voltage of the first initialization signal is greater than a voltage of the second initialization signal; or in responding to the driving transistor being an N-type transistor, the voltage of the first initialization signal is less than the voltage of the second initialization signal.

5. The driving method of the display panel of claim 4, wherein the first preset gray scale value is equal to the second preset gray scale value, and the voltage of the first initialization signal is equal to the voltage of the second initialization signal.

6. The driving method of the display panel of claim 3, wherein in the initialization stage, providing the initialization signal to the gate of the driving transistor of the sub-pixel comprises:

acquiring display brightness of the pre-display image; and determining whether the display brightness of the pre-display image is less than a preset brightness value;

if yes, providing a first initialization signal to the gate of the driving transistor of the sub-pixel in the initialization stage; and if no, providing a second initialization signal to the gate of the driving transistor of the sub-pixel in the initialization stage;

wherein, a voltage of the first initialization signal is greater than a voltage of the second initialization signal.

7. The driving method of the display panel of claim 1, wherein the at least one second sub-pixel comprises a third sub-pixel having a second light emitting color and a fourth sub-pixel having a third light emitting color; wherein a working voltage of the third sub-pixel is less than a working voltage of the fourth sub-pixel;

wherein according to the gray scale data, determining the sub-display region in which all the gray scale values of the first sub-pixels are 0 and all the gray scale values of the second sub-pixels are less than the first preset gray scale value as the first sub-display region, and determining the sub-display region in which not all of the gray scale values of the first sub-pixels are 0 and not all of the gray scale values of the second sub-pixels are less than the first preset gray scale value as the second sub-display region comprises:

according to the gray scale data, determining whether all the gray scale values of the first sub-pixels in the sub-display region are 0;

if yes, determining whether all gray scale value of third sub-pixels in the sub-display region are less than the first preset gray scale value;

if yes, determining whether all gray scale values of fourth sub-pixels in the sub-display region are less than the first preset gray scale value;

if yes, determining the sub-display region as the first sub-display region; and if at least one of conditions that not all of the gray scale values of the first sub-pixels in the sub-display region are 0, not all of the gray scale values of the third sub-pixels in the sub-display region are less than the first preset gray scale value, or not all of the gray scale values of the fourth sub-pixels in the sub-display region are less than the first preset gray scale value exists, determining the sub-display region as the second sub-display region.

8. The driving method of the display panel of claim 7, wherein in the reset stage, providing the first reset signal to the anode of the organic light emitting element of the sub-pixel of the first sub-display region comprises:

determining whether an gray scale value n of the third sub-pixel is greater than an gray scale value m of the fourth sub-pixel;

if yes, in the reset stage, a voltage Vref1 of the first reset signal provided to the anode of the organic light emitting element of the sub-pixel of the first sub-display region is:

$$Vref1=Vref+k*m; \text{ and}$$

if no, in the reset stage, the voltage Vref1 of the first reset signal provided to the anode of the organic light emitting element of the sub-pixel of the first sub-display region is:

$$Vref1=Vref+k*n;$$

wherein k is a correlation coefficient and Vref is a fixed voltage.

9. The driving method of the display panel of claim 8, wherein a voltage of the second reset signal Vref2 provided to the anode of the organic light emitting element of the sub-pixel of the second sub-display region comprises:

$$Vref2=Vref+k*p;$$

wherein p is the first preset gray scale value.

10. The driving method of the display panel of claim 8, wherein a value range of k is $0.1 \leq k \leq 0.2$.

11. The driving method of the display panel of claim 7, wherein the light emitting color of the at least one first sub-pixel is red, the light emitting color of the third sub-pixel is green, and the light emitting color of the fourth sub-pixel is blue.

12. The driving method of the display panel of claim 1, wherein a value range of the first preset gray scale value p is $25 \leq p \leq 35$.

13. A display device, comprising a display panel and a driver chip, wherein the display panel comprises a display region, the display region comprises at least one sub-display region, and each of the at least one sub-display region comprises at least one pixel unit; each of the at least one pixel unit comprises a plurality of sub-pixels having different light emitting colors; each of the plurality of sub-pixels comprises an organic light emitting element; the plurality of sub-pixels of the each of the at least one pixel unit comprises at least one first sub-pixel and at least one second sub-pixel; the at least one second sub-pixel comprises a sub-pixel having at least one emitting color different from an emitting color of the at least one first sub-pixel; and a working voltage of the at least one first sub-pixel is less than a working voltage of each of the at least one second sub-pixel; and the driver chip is configured to execute a driving method of the display panel, wherein the driving method of the display panel comprises:

acquiring gray scale data of a pre-display image, wherein the gray scale data comprises gray scale values in one-to-one correspondence with the plurality of sub-pixels;

according to the gray scale data, determining a sub-display region in which all gray scale values of first sub-pixels are 0 and all gray scale values of second sub-pixels are less than a first preset gray scale value as a first sub-display region, and determining a sub-display region in which not all of the gray scale values of the first sub-pixels are 0 and not all of the gray scale values of the second sub-pixels are less than the first preset gray scale value as a second sub-display region; and in a reset stage, providing a first reset signal to an anode of an organic light emitting element of a sub-pixel of the first sub-display region and a second reset signal to an anode of an organic light emitting element of a sub-pixel of the second sub-display region; wherein a voltage of the first reset signal is less than a voltage of the second reset signal.

14. The display device of claim 13, wherein the each of the plurality of sub-pixels further comprises a pixel driving circuit, the pixel driving circuit at least comprises a reset transistor, and a second pole of the reset transistor is electrically connected to an anode of the organic light emitting element;

the display panel further comprises a scanning driving circuit, at least one reset signal bus, a plurality of reset signal lines and a plurality of first scanning signal lines; and a first output end of the scanning driving circuit is electrically connected to a respective one of the plurality of first scanning signal lines;

gates of reset transistors of sub-pixels in a same row are electrically connected to a same one first scanning signal line; first poles of reset transistors of sub-pixels in a same row and belonging to a same one sub-display region are electrically connected to a same one reset signal line; and reset signal lines electrically connected to reset transistors of a same one sub-display region are electrically connected to a same one reset signal bus; and the driver chip comprises a plurality of reset signal output ends and at least one scanning control end; the at least one scanning control end is electrically connected to a control end of the scanning driving circuit; the plurality of reset signal output ends are electrically connected to the at least one reset signal bus in one-to-one correspondence; and the driver chip is further configured to control the scanning driving circuit to sequentially output a first scanning signal to the respective one of the plurality of first scanning signal lines to control reset transistors of each row of the plurality of sub-pixels to be turned on, and to provide a reset signal to the at least one reset signal bus in one-to-one correspondence, the reset signal is written to the anode of the organic light emitting element through the turned-on reset transistor; wherein the reset signal comprises at least one of a first reset signal or a second reset signal.

15. The display device of claim 14, wherein the display panel comprises a plurality of sub-display regions, the display panel further comprises a plurality of first switch devices arranged in one-to-one correspondence with the plurality of sub-display regions; and a reset signal bus is electrically connected to a plurality of reset signal lines in a same one sub-display region through a respective one of the plurality of first switch devices;

reset transistors in sub-display regions in a same column are electrically connected to a same one reset signal bus through the plurality of reset signal lines and the respective one of the plurality of first switch devices in sequence; and the first switch device is configured to be turned on in a reset stage of sub-pixels of a sub-display region corresponding to the respective one of the plurality of first switch device.

16. The display device of claim 15, wherein the plurality of first switch devices each comprises at least one switch transistor; a first pole of the at least one switch transistor is electrically connected to a reset signal bus, and a second pole of the at least one switch transistor is electrically connected to a reset signal line, a gate of the at least one switch transistor is electrically connected to a first scanning signal line, and the at least one switch transistor is configured to be turned on or off under the control of a first scanning signal transmitted by the first scanning signal line.

17. The display device of claim 13, wherein the each of the plurality of sub-pixels further comprises a pixel driving circuit, the pixel driving circuit at least comprises a driving transistor and an initialization transistor, and a second pole of the initialization transistor is electrically connected to a gate of the driving transistor;

the display panel further comprises a scanning driving circuit, a plurality of reset signal lines and a plurality of second scanning signal lines; and a second output end of the scanning driving circuit is electrically connected to a respective one of the plurality of second scanning signal lines;

gates of initialization transistors of sub-pixels in a same row are electrically connected to a same one second scanning signal line; and first poles of initialization transistors of sub-pixels in a same column are electrically connected to a same one initialization signal line;

the driver chip comprises a plurality of initialization signal output ends and at least one scanning control end; the at least one scanning control end is electrically connected to a control end of the scanning driving circuit; the plurality of initialization signal output ends are electrically connected to the plurality of initialization signal lines in one-to-one correspondence; and the driver chip is further configured to control the scanning driving circuit to sequentially output a second scanning signal to the respective one of the plurality of second scanning signal lines to control initialization transistors of each row of sub-pixels to be turned on, and to provide an initialization signal to a respective one of the plurality of initialization signal lines in one-to-one correspondence, the initialization signal is written to the gate of the driving transistor through a turned-on initialization transistor, wherein the initialization signal comprises at least one of a first initialization signal or a second initialization signal.

18. A driving device of driving a display panel, wherein the display panel comprises a display region, the display region comprises at least one sub-display region, and each of the at least one sub-display region comprises at least one pixel unit; each of the at least one pixel unit comprises a plurality of sub-pixels having different light emitting colors; each of the plurality of sub-pixels comprises an organic light emitting element; the plurality of sub-pixels of the each of the at least one pixel unit comprises at least one first sub-pixel and at least one second sub-pixel; the at least one second sub-pixel comprises a sub-pixel having at least one emitting color different from an emitting color of the at least one first sub-pixel; and a working voltage of the at least one first sub-pixel is less than a working voltage of the at least one second sub-pixel; and the driving device of the display panel comprises:

one or more processors; and one or more memories storing a computer program that when executed by the one or more processors cause the one or more processors to perform operations, the operations comprising:

acquiring gray scale data of a pre-display image, wherein the gray scale data comprises gray scale values in one-to-one correspondence with the plurality of sub-pixels;

according to the gray scale data, determining a sub-display region in which all gray scale values of first sub-pixels are 0 and all gray scale values of second sub-pixels are less than a first preset gray scale value as a first sub-display region, and determining a sub-display region in which not all of the gray scale values of the first sub-pixels are 0 and not all of the gray scale values of the second sub-pixels are less than the first preset gray scale value as a second sub-display region; and in a reset stage, providing a first reset signal to an anode of an organic light emitting element of a sub-pixel of the first sub-display region and a second reset signal to an anode of an organic light emitting element of a sub-pixel of the second sub-display region; wherein a voltage of the first reset signal is less than a voltage of the second reset signal.

* * * * *